US009312646B2

(12) United States Patent
Kuji et al.

(10) Patent No.: US 9,312,646 B2
(45) Date of Patent: Apr. 12, 2016

(54) CONNECTOR AND WIRE HARNESS

(71) Applicant: Hitachi Metals, Ltd., Tokyo (JP)

(72) Inventors: Tomoya Kuji, Yokohama (JP); Sachio Suzuki, Hitachi (JP); Jun Umetsu, Hitachi (JP); Takanori Komuro, Hitachi (JP); Shinya Hayashi, Hitachi (JP); Takahiro Futatsumori, Mito (JP)

(73) Assignee: HITACHI METALS, LTD., Tokyo (JP)

( * ) Notice: Subject to any disclaimer, the term of this patent is extended or adjusted under 35 U.S.C. 154(b) by 6 days.

(21) Appl. No.: 14/260,127

(22) Filed: Apr. 23, 2014

(65) Prior Publication Data

US 2014/0322965 A1 Oct. 30, 2014

(30) Foreign Application Priority Data

Apr. 24, 2013 (JP) ..... 2013-091498

(51) Int. Cl.

| | |
|---|---|
| ***H01R 13/62*** | (2006.01) |
| ***H01R 24/28*** | (2011.01) |
| ***H01R 13/639*** | (2006.01) |
| *H01R 105/00* | (2006.01) |

(52) U.S. Cl.

CPC ..... *H01R 24/28* (2013.01); *H01R 13/639* (2013.01); *H01R 2105/00* (2013.01)

(58) Field of Classification Search

CPC ... H01R 24/28; H01R 13/639; H01R 2105/00
USPC ..... 439/527
See application file for complete search history.

(56) References Cited

U.S. PATENT DOCUMENTS

| | | | | |
|---|---|---|---|---|
| 4,573,754 | A * | 3/1986 | Hill | 439/280 |
| 4,934,367 | A * | 6/1990 | Daglow et al. | 439/527 |
| 6,203,364 | B1 * | 3/2001 | Chupak et al. | 439/527 |
| 7,753,701 | B2 * | 7/2010 | Tsuji | 439/148 |
| 7,874,855 | B1 * | 1/2011 | Ye et al. | 439/188 |
| 7,892,038 | B1 | 2/2011 | Kataoka et al. | |
| 7,959,470 | B1 * | 6/2011 | Umetsu et al. | 439/626 |
| 8,734,173 | B2 * | 5/2014 | Suzuki et al. | 439/262 |
| 8,975,521 | B2 * | 3/2015 | Huang et al. | 174/117 M |
| 2002/0160645 | A1 * | 10/2002 | Nagamine et al. | 439/352 |
| 2004/0166715 | A1 * | 8/2004 | Parrish et al. | 439/352 |

(Continued)

FOREIGN PATENT DOCUMENTS

| | | | |
|---|---|---|---|
| JP | 4905608 | B1 | 3/2012 |
| JP | 2012-134131 | A | 7/2012 |

*Primary Examiner* — Abdullah Riyami
*Assistant Examiner* — Nelson R Burgos-Guntin
(74) *Attorney, Agent, or Firm* — McGinn IP Law Group, PLLC.

(57) ABSTRACT

A connector includes a first terminal housing that houses a first connecting terminal(s) and is attached to a device as an attached object thereof, and a second terminal housing that houses at least a portion of a cable(s) including a second connecting terminal(s) at an end portion thereof. The first connecting terminal(s) and the second connecting terminal(s) come into contact with each other and form a contact point(s) when the first terminal housing is fitted to the second terminal housing. The two terminal housings are fitted in a direction crossing an extending direction of the cable(s) that extends from the second terminal housing. The second terminal housing further includes a fixing means on a cable side with respect to the contact point(s) so as to fix a portion housing the cable(s) to the device or another member integrally fixed to the device.

19 Claims, 12 Drawing Sheets

(56) References Cited

U.S. PATENT DOCUMENTS

| | | | | |
|---|---|---|---|---|
| 2005/0048843 | A1* | 3/2005 | Iida | 439/620 |
| 2006/0086900 | A1* | 4/2006 | Nakamura | 250/239 |
| 2008/0076303 | A1* | 3/2008 | Zhang | 439/668 |
| 2009/0258531 | A1* | 10/2009 | Oka | 439/382 |
| 2009/0298320 | A1* | 12/2009 | Schmitt et al. | 439/352 |
| 2011/0014822 | A1* | 1/2011 | Kato et al. | 439/733.1 |
| 2011/0221654 | A1* | 9/2011 | Hsu | 343/906 |
| 2011/0256748 | A1* | 10/2011 | Davison et al. | 439/345 |
| 2012/0052734 | A1* | 3/2012 | Fukuda et al. | 439/626 |
| 2012/0052747 | A1* | 3/2012 | Kataoka et al. | 439/701 |
| 2012/0077360 | A1* | 3/2012 | Hattori et al. | 439/153 |
| 2012/0184152 | A1* | 7/2012 | Kataoka et al. | 439/660 |
| 2013/0322049 | A1* | 12/2013 | Ishikawa et al. | 361/823 |
| 2014/0017947 | A1* | 1/2014 | Uno et al. | 439/626 |
| 2014/0287631 | A1* | 9/2014 | Tashiro et al. | 439/733.1 |
| 2014/0291017 | A1* | 10/2014 | Kuji et al. | 174/72 A |
| 2014/0322965 | A1* | 10/2014 | Kuji et al. | 439/527 |

* cited by examiner

CONNECTOR AND WIRE HARNESS

The present application is based on Japanese patent application No. 2013-091498 filed on Apr. 24, 2013, the entire contents of which are incorporated herein by reference.

BACKGROUND OF THE INVENTION

1. Field of the Invention

The invention relates to a connector potentially employed for a power harness used in eco-friendly cars such as hybrid cars and electric cars especially to transmit a large amount of power, and a wire harness.

2. Description of the Related Art

A power harness is used for connecting between devices such as between a motor and an inverter or between an inverter and a battery in, e.g., a hybrid car or an electric car, which has made significant progress in recent years, to transmit a large amount of power, and a connector in a two-divided structure composed of, e.g., a first connector portion provided with a first connecting terminal(s) as well as a first terminal housing for housing the first connecting terminal(s) and a second connector portion provided with a second connecting terminal(s) connected to the first connecting terminal(s) as well as a second terminal housing for housing the second connecting terminal(s) is provided to one end of the power harness.

In recent years, all components in such eco-friendly cars have been lightened in weight in order to improve energy saving performance, and size reduction is desired as one of effective means of reducing weight.

The present applicant has proposed a laminated-type connector having a laminated structure in which, when a first terminal housing is fitted to a second terminal housing, plural first connecting terminals and plural second connecting terminals are alternately arranged so that surfaces of the first connecting terminals respectively face surfaces of the second connecting terminals to form pairs and plural contact points formed therebetween are sandwiched between the insulating members (See JP-B-4905608).

In the connector of JP-B-4905608, a connecting member is provided to press an insulating member adjacent thereto to collectively fix and electrically connect the plural first connecting terminals to the plural second connecting terminals at each contact point, and an insulating member assembly is formed by connecting the plural insulating members to each other and restricts the insulating members from moving in a fitting direction and a width direction which is perpendicular to a lamination direction of the laminated structure and to the fitting direction.

Such a configuration realizes a small laminated-type connector by eliminating a retaining jig for holding the insulating members and also allows positional misalignment of the insulating members to be prevented even in the case that an excessive force is applied to a cable.

Furthermore, in order to reduce the length of a connector part protruding from a device when the connector is directly connected to the device, the present applicant has proposed an L-shaped laminated-type connector in which two terminal housings are fitted so that the length direction of the first connecting terminals intersects with that of the second connecting terminals.

The related arts to the invention may include JP-B-4905542 as well as JP-B-4905608.

SUMMARY OF THE INVENTION

The L-shaped connector as proposed may be used such that cables are disposed extending parallel to the surface of a shielding case etc. of the device to which the first connector portion is attached. This may raise the problem that the vibration of the cables due to a vibration etc. generated under the in-vehicle environment is transmitted to the contact points, whereby a frictional wear may occur on the first and second connecting terminals.

Especially in the laminated-type connector, where plural contact points are secured together by being pressed by a connecting member, a misalignment may occur between the connecting terminals when a force to rotate around the pressing direction thereof is applied. Therefore, countermeasures therefor are demanded.

It is an object of the invention to provide a connector that prevents the frictional wear of the connecting terminals due to the vibration, as well as a wire harness using the connector.

(1) According to one embodiment of the invention, a connector comprises:

a first terminal housing that houses a first connecting terminal(s) and is attached to a device as an attached object thereof; and a second terminal housing that houses at least a portion of a cable(s) comprising a second connecting terminal(s) at an end portion thereof, wherein the first connecting terminal(s) and the second connecting terminal(s) come into contact with each other and form a contact point(s) when the first terminal housing is fitted to the second terminal housing, wherein the two terminal housings are fitted in a direction crossing an extending direction of the cable(s) that extends from the second terminal housing, and wherein the second terminal housing further comprises a fixing means on a cable side with respect to the contact point(s) so as to fix a portion housing the cable(s) to the device or another member integrally fixed to the device.

In the above embodiment (1) of the invention, the following modifications and changes can be made.

(i) The second terminal housing is formed in a hollow cylinder shape having an opening on one side and further comprises a cylindrical body with the opening to be fitted to the first terminal housing and a cable insertion portion for inserting the cable, the cable insertion portion being formed integrally with a side surface of the cylindrical body so as to be in communication with a hollow portion of the cylindrical body, and wherein the fixing means is provided on the cable insertion portion so that the cable insertion portion is fixed to the device or another member integrally fixed to the device.

(ii) The fixing means further comprises a bolt fixing portion to be fixed to the device or another member integrally fixed to the device by a bolt and a connecting portion for connecting the bolt fixing portion to the cable insertion portion.

(iii) The connector further comprises a tail plate having a two-divided structure to sandwich and hold the cable(s), wherein the cable(s) is fixed to the second terminal housing by fixing the tail plate to the second terminal housing.

(iv) A plurality of the first connecting terminals aligned are housed in the first terminal housing, wherein a plurality of the second connecting terminals aligned and a plurality of insulating members aligned are housed in the second terminal housing, wherein a laminated structure is formed such that the first connecting terminals and the second connecting terminals are alternately arranged so that surfaces of the plurality of first connecting terminals face surfaces of the plurality of second connecting terminals to form pairs and to form a plurality of contact points sandwiched between the insulating members when the first terminal housing is fitted to the second terminal housing, and wherein a connecting member is provided to collectively fix and electrically connect the plurality of first connecting terminals and the plurality of second connecting terminals at each contact point by pressing the insulating member adjacent thereto.

(v) The contact point(s) is formed inside the second terminal housing and outside the device.

(2) According to another embodiment of the invention, a wire harness comprises:

a cable(s);

a second connecting terminal(s) provided at an end portion of the cable(s); and a second terminal housing that houses at least a portion of the cable(s) comprising the second connecting terminal(s) at the end portion thereof, wherein the first connecting terminal(s) and the second connecting terminal(s) come into contact with each other and form a contact point(s) when the second terminal housing is fitted to a first terminal housing that is a housing to be fitted to the second terminal housing, houses the first connecting terminals and is attached to a device as an attached object, wherein the two terminal housings are fitted in a direction crossing an extending direction of the cable(s) that extends from the second terminal housing, and wherein the second terminal housing further comprises a fixing means on a cable side with respect to the contact point(s) so as to fix a portion having the cable(s) to the device or another member integrally fixed to the device.

Effects of the Invention

According to one embodiment of the invention, a connector can be provided that prevents the frictional wear of the connecting terminals due to the vibration, as well as a wire harness using the connector.

BRIEF DESCRIPTION OF THE DRAWINGS

Next, the present invention will be explained in more detail in conjunction with appended drawings, wherein:

FIGS. 1A and 1B are diagrams illustrating a connector in the present embodiment, wherein FIG. 1A is a side view and FIG. 1B is a plan view;

FIGS. 5A and 5B are diagrams illustrating the first connecting terminals of the first connector portion of FIGS. 4A and 4B, wherein FIG. 5A is a perspective view and FIG. 5B is a plan view showing the first connecting terminals as viewed from the back side in an insertion direction thereof.

FIGS. 13A to 13D are diagrams illustrating a connecting member of the second connector portion of FIG. 7, wherein FIG. 13A is a perspective view, FIG. 13B is a cross sectional view, FIG. 13C is a perspective view showing a cam and FIG. 13D is a perspective view showing a bolt;

DETAILED DESCRIPTION OF THE PREFERRED EMBODIMENTS

An embodiment of the invention will be described below in conjunction with the appended drawings.

Figure 1A:
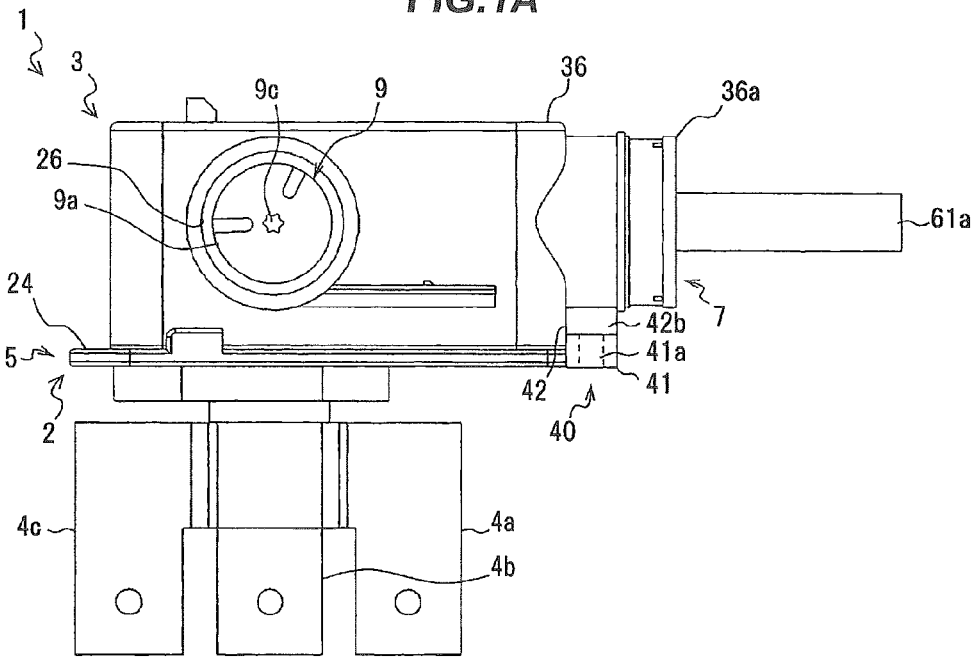
Figure 1B:
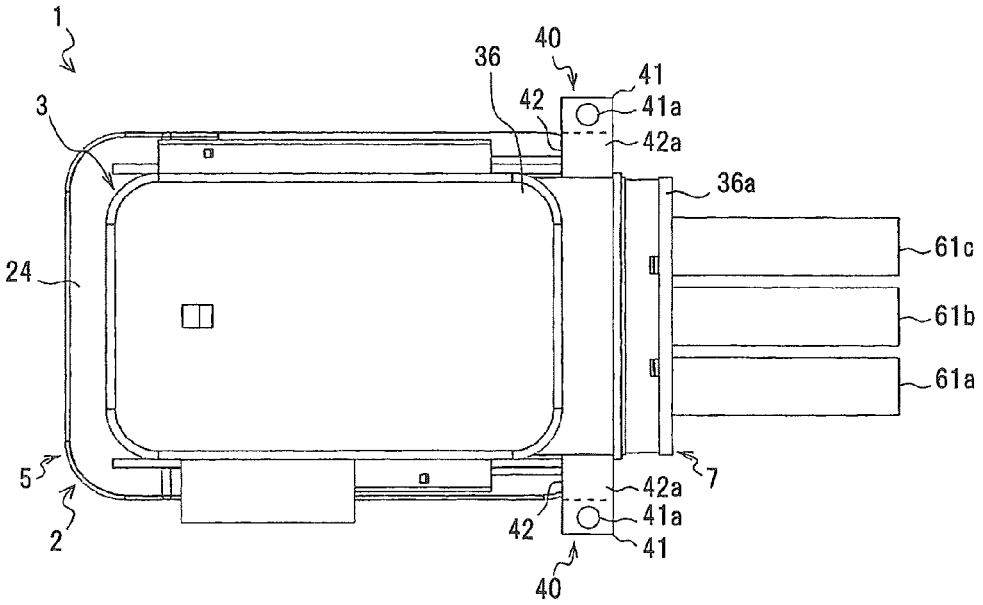
Figure 2A:
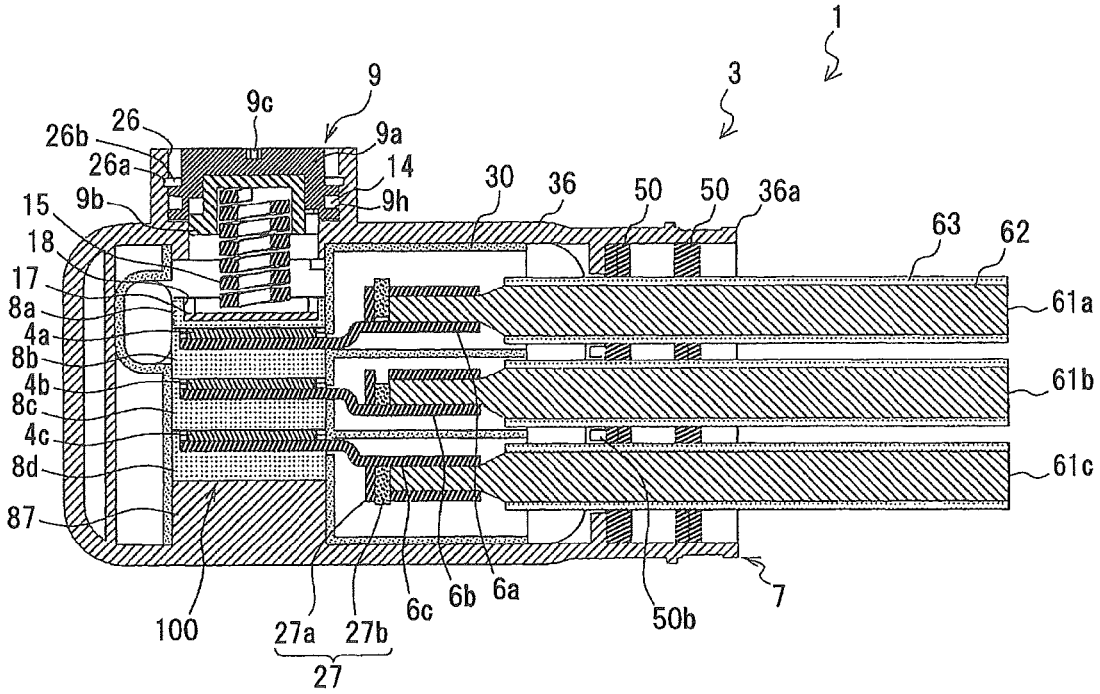
FIG. 2A is a cross sectional view showing the connector of FIG. 1.
Figure 2B:
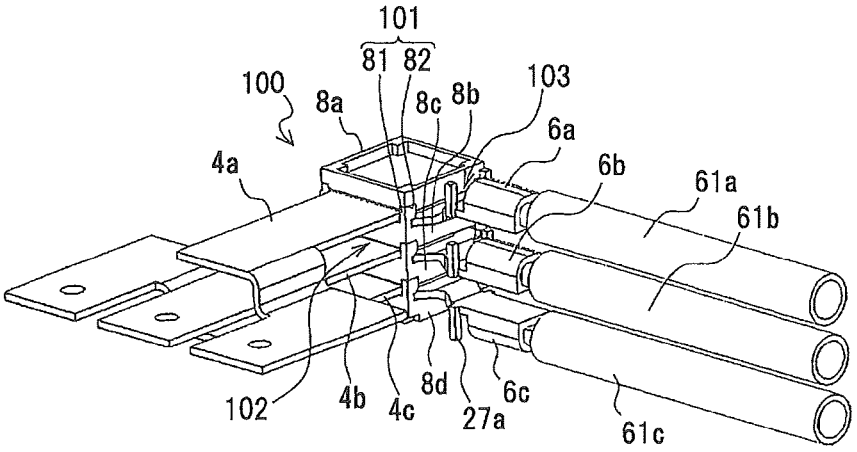
FIG. 2B is a perspective view showing only first and second connecting terminals and an insulating member assembly.
Figure 3:
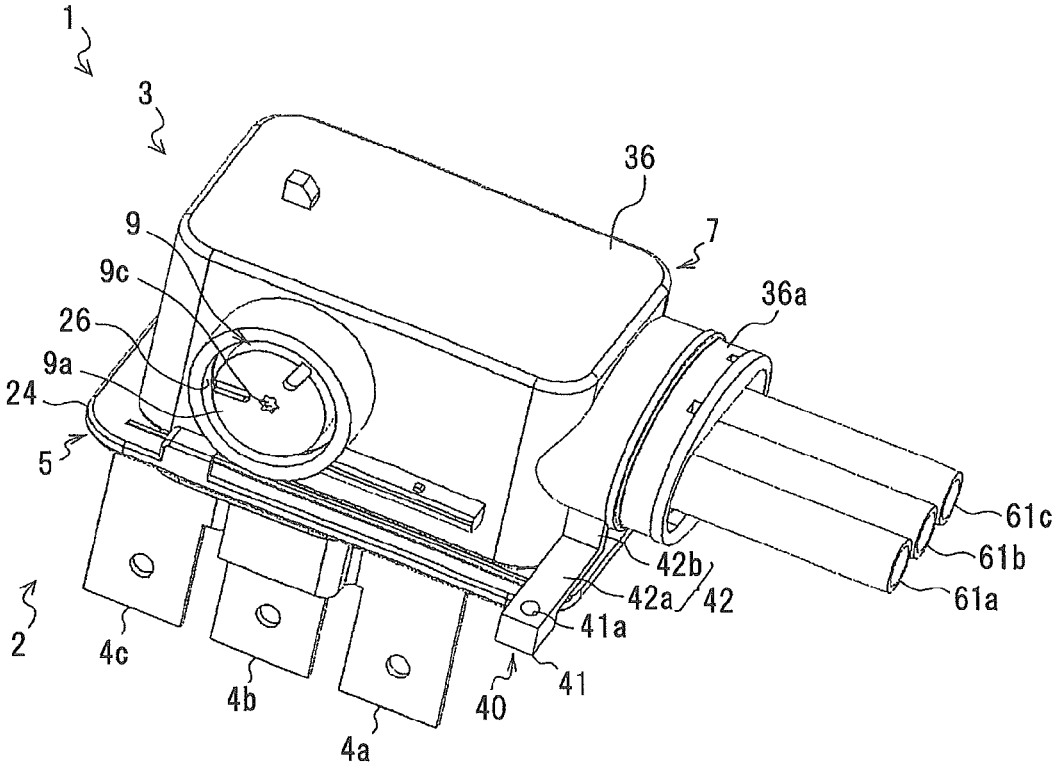
FIG. 3 is a perspective view showing the connector of FIG. 1.
Figure 4A:
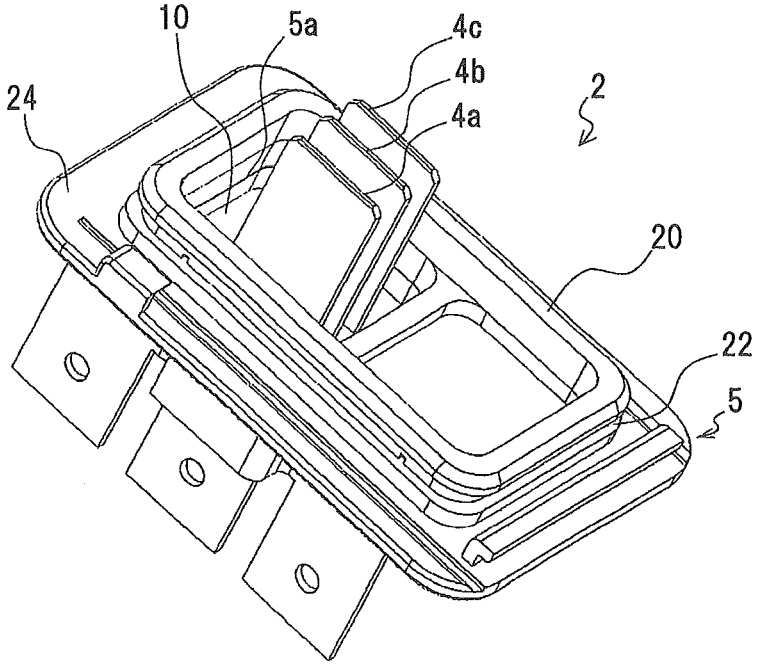
FIGS. 4A and 4B are perspective views showing a first connector portion of the connector of FIG. 1.
Figure 4B:
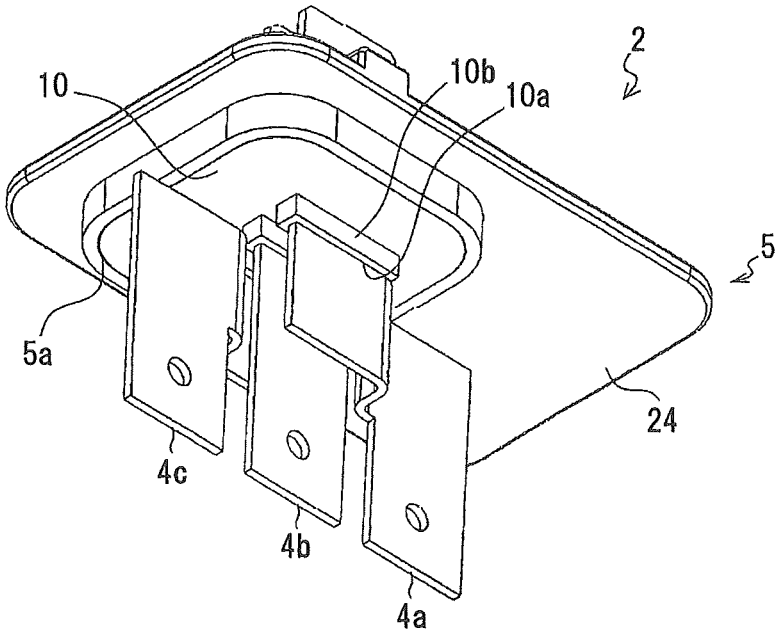

FIGS. 1A to 3 are diagrams illustrating a connector in the present embodiment, wherein FIG. 1A is a side view, FIG. 1B is a plan view, FIG. 2A is a cross sectional view, FIG. 2B is a perspective view showing only first and second connecting terminals and an insulating member assembly and FIG. 3 is a perspective view.

As shown in FIGS. 1A to 3, a connector 1 in the present embodiment is composed of a first connector portion 2 and a second connector portion 3, and plural power lines are connected at a time by fitting the connector portions 2 and 3 together.

More specifically, the connector 1 is provided with the first connector portion 2 having a first terminal housing (male terminal housing) 5 housing plural (three) aligned first connecting terminals (male terminals) 4*a* to 4*c*, the second connector portion 3 having a second terminal housing (female terminal housing) 7 housing plural (three) aligned second connecting terminals (female terminals) 6*a* to 6*c*, and plural (four) insulating members 8*a* to 8*d* aligned and housed in the second terminal housing 7 for insulating the second connecting terminals 6*a* to 6*c* from each other.

The connector 1 is configured that, inside the first terminal housing 5 of the first connector portion 2 and the second terminal housing 7 of the second connector portion 3 which are fitted to each other, the first connecting terminals 4*a* to 4*c* and the second connecting terminals 6*a* to 6*c* are alternately arranged to form a laminated structure in which surfaces of the plural first connecting terminals 4*a* to 4*c* on one side face surfaces of the plural second connecting terminals 6*a* to 6*c* on one side to form respective pairs (a pair of the first connecting terminal 4*a* and the second connecting terminal 6*a*, that of the first connecting terminal 4*b* and the second connecting terminal 6*b*, and that of the first connecting terminal 4*c* and the second connecting terminal 6*c*) and to form plural contact points therebetween, and each contact point is sandwiched by two of the insulating members 8*a* to 8*d*.

In the connector 1, the first connector portion 2 is attached to a shielding case of a device such as inverter or motor so that the length direction of the first connecting terminals 4*a* to 4*c* is perpendicular to a surface of the device (including the shielding case), and the first connecting terminals 4*a* to 4*c* in the non-illustrated shielding case are electrically connected to the power lines of the device. Cables 61*a* to 61*c* are connected to the second connector portion 3, and are respectively electrically connected to the power lines of the device by connecting the first connector portion 2 to the second connector portion 3. In the present embodiment, the second terminal housing 7 of the second connector portion 3 is configured such that the cables 61*a* to 61*c* extend in the length direction of the second connecting terminals 6*a* to 6*c*. Note that, although the second connecting terminals 6*a* to 6*c* are entirely housed in the second terminal housing 7 in the present embodiment, the second connecting terminals 6*a* to 6*c* may be exposed from the second terminal housing 7 as long as at least a portion of the cables 61*a* to 61*c* having the second connecting terminals 6*a* to 6*c* at end portions thereof is housed in the second terminal housing 7.

The connector 1 is configured that the two terminal housings 5 and 7 are fitted so that a length direction of the first connecting terminals 4*a* to 4*c* crosses that of the second connecting terminals 6*a* to 6*c*. In the present embodiment, the connector 1 is configured that the two terminal housings 5 and 7 are fitted so that the length direction of the first connecting terminals 4*a* to 4*c* is orthogonal to that of the second connecting terminals 6*a* to 6*c*. In other words, the connector 1 is configured that the two terminal housings 5 and 7 are fitted in a direction crossing the extending direction of the cables 61*a* to 61*c* which extend from the second terminal housing 7. Therefore, in the connector 1, when the two terminal housings 5 and 7 are fitted to each other, the cables 61*a* to 61*c* extend in a direction parallel to a surface of the device to which the first terminal housing 5 is attached, and the fitting direction of the two terminal housings 5 and 7 is thus orthogonal to the extending direction of the cables 61*a* to 61*c*.

The wire harness of the present embodiment is the cables 61*a* to 61*c* with the connector 1 (the second connector portion 3) provided at an end portion thereof.

Each configuration of the connector portions 2 and 3 will be described in detail below.

First Connector Portion

Firstly, the first connector portion 2 will be described.

As shown in FIGS. 1A to 6, the first connector portion 2 is provided mainly with the first connecting terminals 4*a* to 4*c*, the first terminal housing 5 and a first inner housing 10.

Electricity of different voltage and/or current is transmitted to each of the first connecting terminals 4*a* to 4*c*. For example, the present embodiment assumes the use of a three-phase AC power line between a motor and an inverter, and alternate current having a phase difference of 120° is transmitted to each of the first connecting terminals 4*a* to 4*c*. Each of the first connecting terminals 4*a* to 4*c* should be formed of a highly conductive metal such as silver, copper or aluminum to reduce transmission loss, etc., in the connector 1. In addition, each of the first connecting terminals 4*a* to 4*c* has little flexibility.

For shielding performance, heat dissipation and weight saving of the connector 1, the first terminal housing 5 is preferably formed of light metal having high electrical and thermal conductivity such as aluminum, but may be formed of resin, etc. In the present embodiment, the first terminal housing 5 is formed of aluminum.

The first inner housing 10 is formed of an insulating resin (e.g., PPS (polyphenylene sulfide) resin, PPA (polyphthalamide) resin, PA (polyamide) resin, PBT (polybutylene terephthalate) and epoxy-based resin), etc.

The first connecting terminals 4*a* to 4*c* are respectively inserted into through-holes 10*a* formed on the first inner housing 10 and are then fixed. The first inner housing 10 is attached to the first terminal housing 5 so as to cover a terminal-attaching hole 5*a* formed on the first terminal housing 5, and the first connecting terminals 4*a* to 4*c* are thereby fixed to the first terminal housing 5 via the first inner housing 10 and are held in the first terminal housing 5 in the state of being aligned at predetermined intervals. Protruding portions 10*b* are provided on the first inner housing 10 so as to protrude outward from rims of the through-holes 10*a*. This increases a contact area of the first inner housing 10 with the first connecting terminals 4*a* to 4*c* and it is thus possible to firmly hold the first connecting terminals 4*a* to 4*c*, The first terminal housing 5 is composed of a hollow cylindrical body 20 having a substantially rectangular horizontal cross-section and a lid portion 24 which is provided integrally with the cylindrical body 20 so as to cover one of openings of the cylindrical body 20 and has the terminal-attaching hole 5*a* formed thereon. The lid portion 24 is a flange-shaped portion to be in contact with a surface of the shielding case when the first connector portion 2 is attached to the shielding case of the device.

Note that, the first terminal housing 5 may be a portion of the shielding case (a portion of the device as an attachment target). In other words, the structure may be such that a housing provided on the cables 61*a* to 61*c* is fitted to an insertion hole formed on the shielding case of the device. In this case, such a portion of the shielding case serves as the first terminal housing 5 and the housing provided on the cables 61*a* to 61*c* to be fitted to the insertion hole serves as the second terminal housing 7.

The cylindrical body 20 is housed in the second terminal housing 7 when the two terminal housings 5 and 7 are fitted to each other. A groove 22 is formed on the outer periphery of the cylindrical body 20 along a circumferential direction and a packing (not shown) such as O-ring is placed in the groove 22 to make watertight between the second terminal housing 7 and the cylindrical body 20 when the two terminal housings 5 and 7 are fitted to each other. At an end portion of the cylindrical body 20 opposite to the lid portion 24, an edge on the outer peripheral side is formed in a tapered shape in light of fitting properties to the second terminal housing 7. Note that, although a packing is provided on the first terminal housing 5 (in the groove 22 of the cylindrical body 20) in the embodiment, the packing may be provided on the second terminal housing 7. In this case, it is preferable that a groove for placing the packing be formed on an inner periphery of the second terminal housing 7, In the first terminal housing 5, the first connecting terminals 4*a* to 4*c* are arranged so as to be aligned in the thickness direction thereof. In the present embodiment, the first connecting terminals 4*a* and 4*c* are shaped into a crank shape so that the first connecting terminals 4*a* to 4*c* at a portion exposed to the outside from the first terminal housing 5 are aligned in a width direction.

Figure 5A:
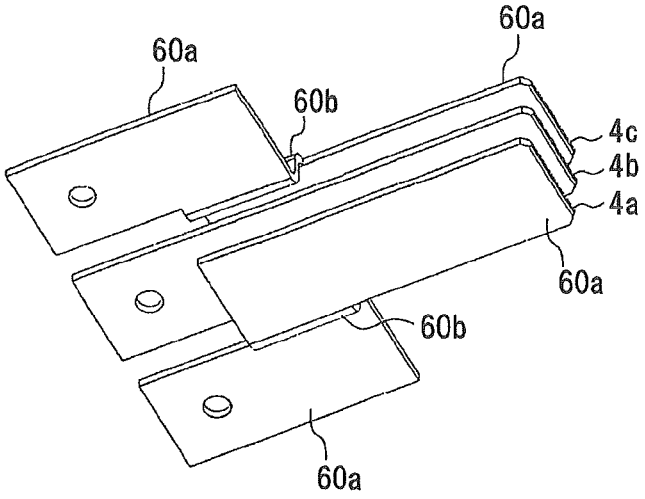
Figure 5B:
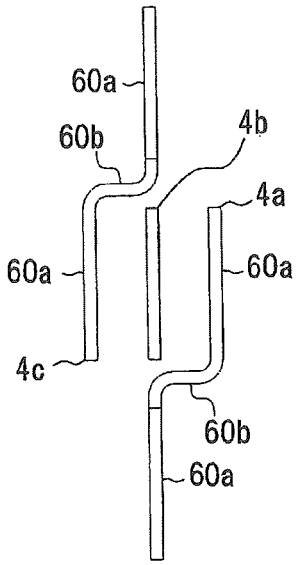
Figure 6:
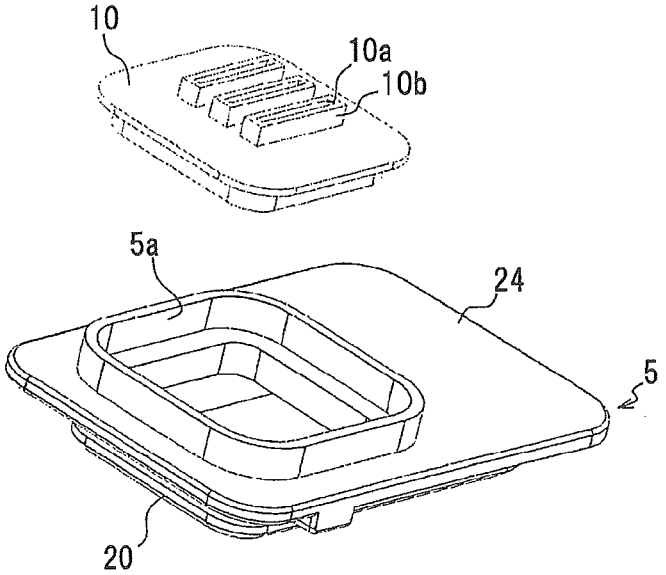
FIG. 6 is a perspective view showing a first terminal housing and a first inner housing of the first connector portion of FIGS. 4A and 4B.

As shown in FIGS. 5A and 5B, an S-shaped connecting portion 60*b* connects between side faces of end portions of two parallel plate-like members 60*a*, and the first connecting terminals 4*a* and 4*c* are thereby formed in a crank shape as viewed from any of the thickness direction, the width direction and the length direction. The first connecting terminals 4*a* and 4*c* are formed in the same shape and are arranged symmetric about the center of the first connecting terminal 4*b* in the thickness and width directions (180° rotational symmetry). Such a configuration allows an arrangement direction of terminals to be changed without impairing symmetric properties of the power lines, hence, easy connection to the power lines of the device. Note that, the shape of the first connecting terminals 4*a* to 4*c* at the portion exposed to the outside from the first terminal housing 5 is not limited thereto and can be appropriately changed according to requirements on the device side. The tip portions of the first connecting terminals 4*a* to 4*c* are chamfered (or rounded) for easy insertion into a below-described insulating member assembly 100.

Second Connector Portion

Next, the second connector portion 3 will be described.

As shown in FIGS. 1A to 3 and 7 to 8B, the second connector portion 3 holds, inside thereof, three second connecting terminals 6*a* to 6*c* aligned at predetermined intervals, and is provided with the second terminal housing 7 housing the three aligned second connecting terminals 6*a* to 6*c*, plural insulating members 8*a* to 8*d* in a substantially rectangular parallelepiped shape which are provided in the second terminal housing 7 for insulating the second connecting terminals 6*a* to 6*c* from each other, and a connecting member 9 for collectively fixing and electrically connecting the plural first connecting terminals 4*a* to 4*c* to the plural second connecting terminals 6*a* to 6*c* at respective contact points by pressing the adjacent insulating member 8*a*.

The cables 61*a* to 61*c* extending from a motor are respectively connected to the second connecting terminals 6*a* to 6*c* on one side. The cables 61*a* to 61*c* are each composed of a conductor 62 and an insulation layer 63 formed on the outer periphery thereof. The conductor 62 having a cross-sectional area of 50 $mm^2$ is used in the present embodiment.

Each of the second connecting terminals 6*a* to 6*c* should be formed of a highly conductive metal such as silver, copper or aluminum to reduce transmission loss, etc., in the connector 1. In addition, each of the second connecting terminals 6*a* to 6*c* has little flexibility.

Figure 9:
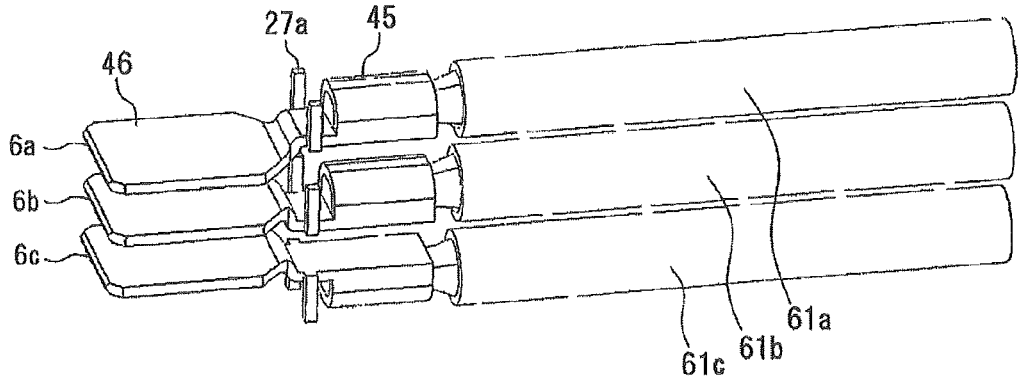
FIG. 9 is a perspective view showing second connecting terminals of the second connector portion and cables of FIG. 7.

As shown in FIG. 9, each of the second connecting terminals 6*a* to 6*c* has a crimping portion 45 for crimping the conductor 62 exposed at a tip portion of each of the cables 61*a* to 61*c* and a plate-like member 46 integrally formed with the crimping portion 45, and is formed in a crank shape by bending the plate-like member 46 at the base end portion (a connecting portion with the crimping portion 45) into an S-shape. Protrusions 27*a* are formed on the plate-like member 46 so as to protrude upward (downward) from both widthwise edges at the base end portion of the plate-like member 46. The protrusions 27*a* constitute a below-described slip-off prevention mechanism 27. The tip portions of the second connecting terminals 6*a* to 6*c* are chamfered (or rounded) for easy insertion into the insulating members 8*b* to 8*d*.

Figure 7:
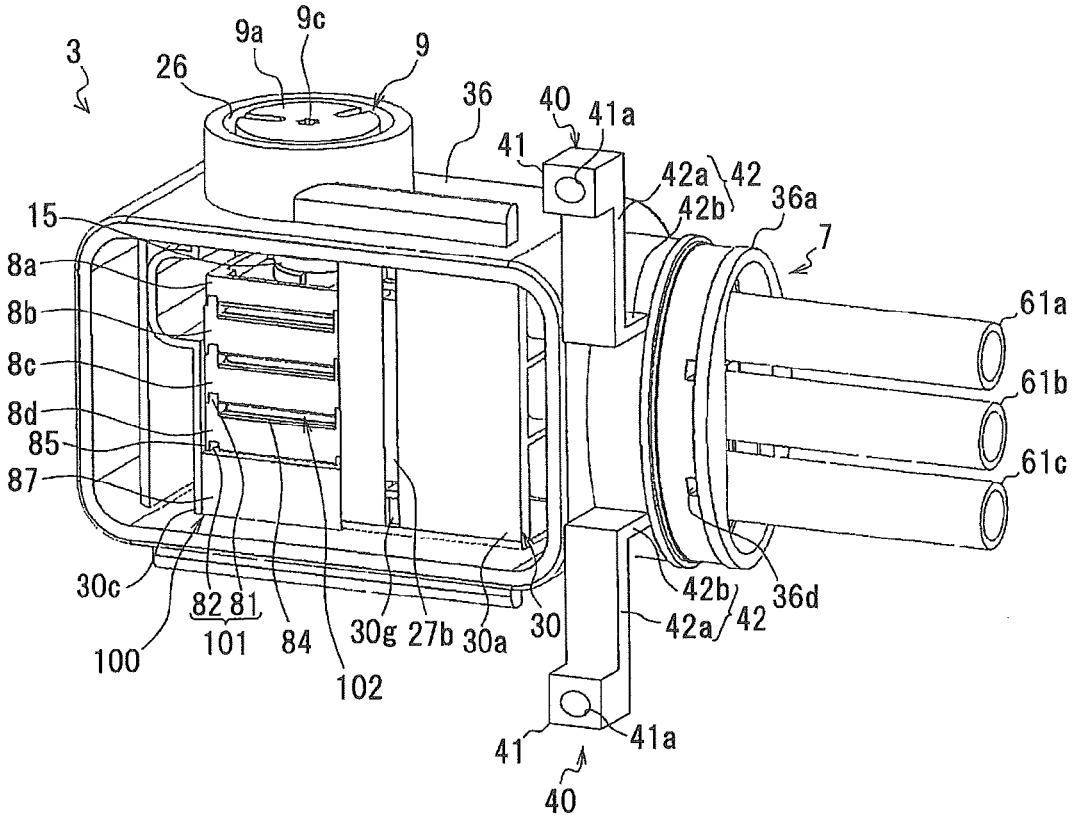
FIG. 7 is a perspective view showing a second connector portion of the connector of FIG. 1.
Figure 8A:
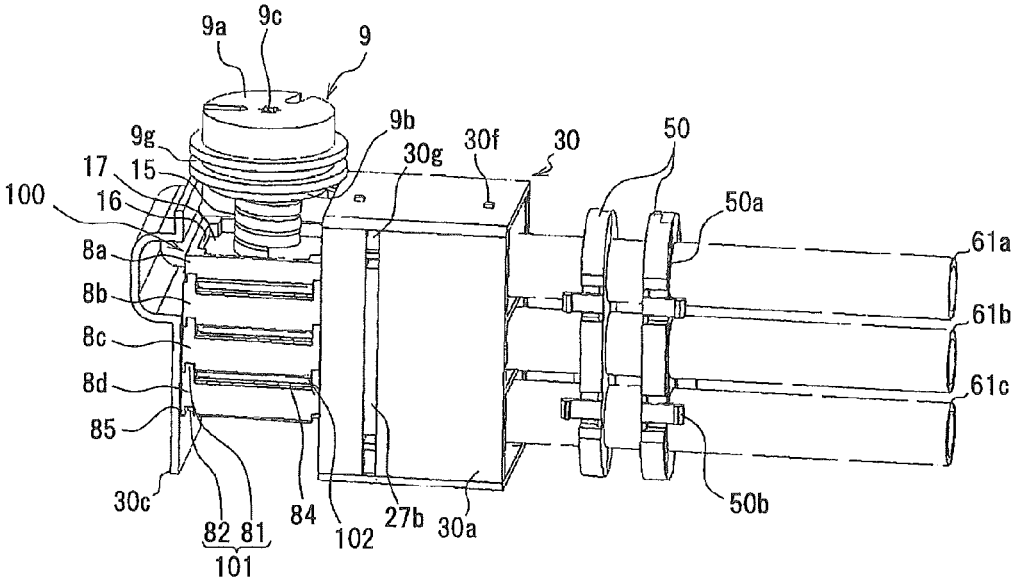
FIG. 8A is a perspective view showing the second connector portion of FIG. 7 where the second terminal housing is removed.
Figure 8B:
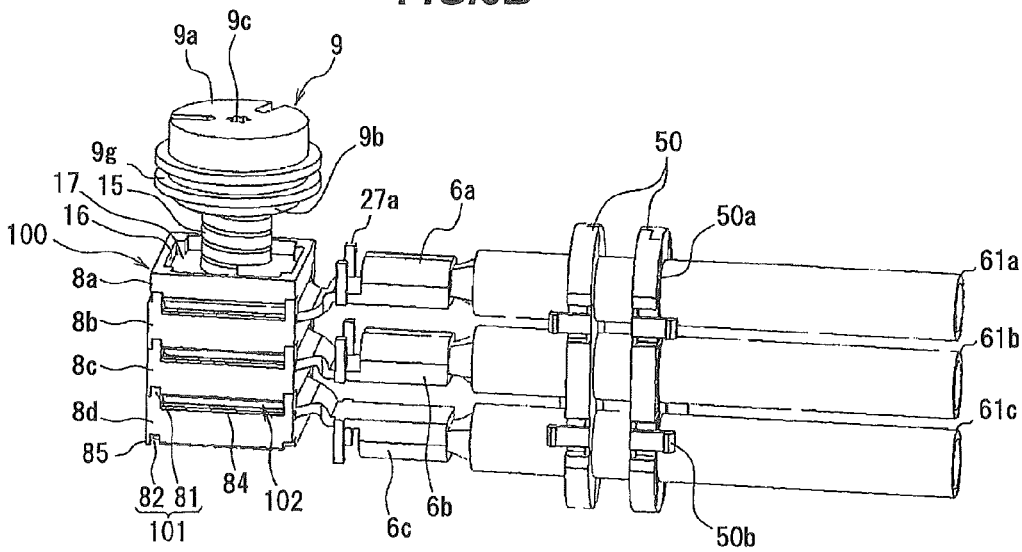
FIG. 8B is a perspective view where the second inner housing is further removed.

As shown in FIGS. 7 to 8B, a second inner housing 30, which is constructed from a resin molded article and has a multi-cylindrical shape (a shape formed of contiguous plural cylinders), holds the cables 61*a* to 61*c* aligned at predetermined intervals. The second connecting terminals 6*a* to 6*c* are fixed to the second terminal housing 7 via the cables 61*a* to 61*c* and the second inner housing 30. At this time, the second connecting terminals 6*a* to 6*c* are positioned and held respectively under (on the opposite side to the connecting member 9) the first connecting terminals 4*a* to 4*c* (i.e., connection targets) which respectively face and are paired with the second connecting terminals 6*a* to 6*c* when the first connector portion 2 is fitted to the second connector portion 3.

The second inner housing 30 is formed of an insulating resin (e.g., PPS (polyphenylene sulfide) resin, PPA (polyphthalamide) resin, PA (polyamide) resin, PBT (polybutylene terephthalate) and epoxy-based resin), etc., to prevent short circuit by insulating the second connecting terminals 6*a* to 6*c* from each other. The second inner housing 30 allows the second connecting terminals 6*a* to 6*c* to be held at respective predetermined positions even when each of the cables 61*a* to 61*c* respectively connected to the second connecting terminals 6*a* to 6*c* is very flexible. In other words, since a cable excellent in flexibility can be used as the cables 61*a* to 61*c* in the present embodiment, it is possible to improve the wiring flexibility for laying the cables 61*a* to 61*c*.

Figure 10A:
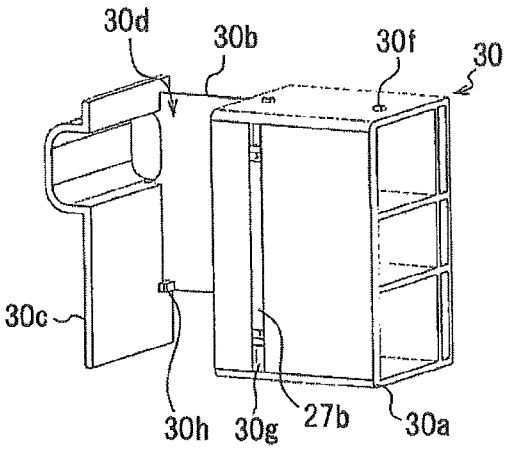
FIGS. 10A and 10B are perspective views showing the second inner housing of the second connector portion of FIG. 7.
Figure 10B:
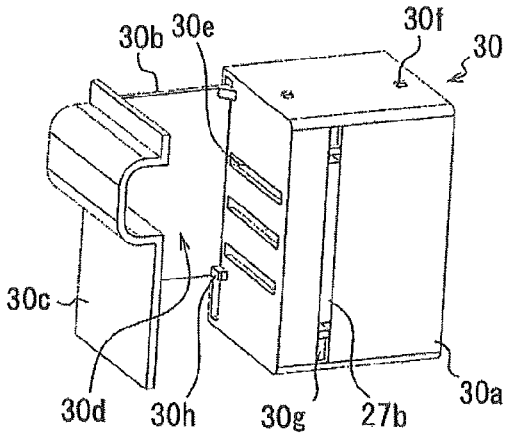

As shown in FIGS. 10A and 10B, the second inner housing 30 is formed in a multi-cylindrical shape composed of three contiguous square cylinders each opened on one side, has a main body 30*a* formed in a rectangular parallelepiped shape as a whole, a plate-like parallel portion 30*b* extending from a side edge portion of the main body 30*a* in an insertion direction of the cables 61*a* to 61*c* and a plate-like vertical portion 30*c* orthogonally extending from the front edge of the parallel portion 30*b*, and is configured that the insulating members 8*a* to 8*d* are housed in a space 30*d* which is surrounded by the parallel portion 30*b*, the vertical portion 30*c* and a surface of the main body 30*a* on the front side in the insertion direction of the cables 61*a* to 61*c*.

Positioning protrusions 30*h* are formed at the lower edge portion of the parallel portion 30*b*, in more detail, at corners located at the lower edge portion of the parallel portion 30*b* and respectively at an intersection of the parallel portion 30*b* and the surface of the main body 30*a* on the front side in the insertion direction of the cables 61*a* to 61*c* and an intersection of the vertical portion 30*c* and the parallel portion 30*b*. The positioning protrusions 30*h* are inserted into connecting grooves 82 of the outermost first insulating member 8*d* (described later) to position the insulating member assembly 100 (described later) with respect to the second terminal housing 7.

Terminal insertion holes 30*e* for inserting the second connecting terminals 6*a* to 6*c* (for exposing the tip portions of the second connecting terminals 6*a* to 6*c* from the main body 30*a*) are formed on the surface of the main body 30*a* on the front side in the insertion direction of the cables 61*a* to 61*c*. In addition, locking protrusions 30*f* for locking and fixing the second inner housing 30 to the second terminal housing 7 are formed on upper and lower surfaces of the main body 30*a* (both side surfaces in the arrangement direction of the cables 61*a* to 61*c*).

Although the second connecting terminals 6*a* to 6*c* in the present embodiment are inserted into the terminal insertion holes 30*e* so that the second connecting terminals 6*a* to 6*c* are directly held by the second inner housing 30 and are positioned, it is not limited thereto. It is also possible to position the second connecting terminals 6*a* to 6*c* by holding the cables 61*a* to 61*c* (in more detail, by holding the end portion of the cables 61*a* to 61*c* at a position close to the second connecting terminals 6*a* to 6*c*). Note that, it is preferable that the terminal insertion hole 30*e* be formed slightly larger than the second connecting terminals 6*a* to 6*c* so that deformation of the second connecting terminals 6*a* to 6*c* is suppressed when pressed by the connecting member 9.

The second connector portion 3 is provided with the slip-off prevention mechanism 27 so that the cables 61*a* to 61*c* are not pulled out from the second inner housing 30 even when the cables 61*a* to 61*c* are pulled. The slip-off prevention mechanism 27 is composed of the protrusions 27*a* formed at the respective base end portions of the second connecting terminals 6*a* to 6*c* (in the vicinity of the cables 61*a* to 61*c*; in the present embodiment, at an end portion of the plate-like member 46 on the crimping portion 45 side), and an inner plate 27*b* for locking the protrusions 27*a* to restrict the protrusions 27*a* from moving backward (toward the cables 61*a* to 61*c*) (see FIG. 2A). An inner plate insertion hole 30*g* is formed on a side surface of the main body 30*a* (a side surface facing the opening of the second terminal housing 7) and the inner plate 27*b* is inserted therethrough so as to protrude into each of the multiple cylinders after the cables 61*a* to 61*c* and the second connecting terminals 6*a* to 6*c* are inserted into the main body 30*a* of the second inner housing 30, thereby providing the inner plate 27*b*. Note that, the structure of the inner plate 27*b* is not limited in the present embodiment and any structure is acceptable as long as the protrusions 27*a* of the three second connecting terminals 6*a* to 6*c* are locked and movement of the protrusions 27*a* is restricted.

As shown in FIGS. 1A to 2B, 7, 11A and 11B, the second terminal housing 7 is constructed from a hollow cylindrical body 36 opening on one side and having a substantially rectangular cross section, and is configured that the first terminal housing 5 is inserted and fitted to the opening of the cylindrical body 36. A cylindrical cable insertion portion 36*a* for inserting the cables 61*a* to 61*c* is formed integrally on the lateral side of the cylindrical body 36 (the side surface on the right side in 11A and 11B). A hollow portion in the cylindrical body 36 is in communication with that in the cable insertion portion 36*a* via three rectangular insertion holes 36*f* for passing the cables 61*a* to 61*c*, and the cables 61*a* to 61*c* pass through the hollow portion in the cable insertion portion 36*a* and the insertion holes 36*f* and are then inserted into the cylindrical body 36. The insertion direction of the first terminal housing 5 is orthogonal to the insertion direction of the cables 61*a* to 61*c*.

Now, a fixing means 40 which is an essential part of the invention will be described.

The connector 1 in the embodiment is provided with the fixing means 40 which is a portion of the second terminal housing 7 on the cables 61*a* to 61*c* side with respect to the contact points and fixes a portion housing the cables 61*a* to 61*c* (the cable insertion portion 36*a*) to the device (including the shielding case) to which the first terminal housing 5 is attached. Although the case where the fixing means 40 fixes the second terminal housing 7 to the device will be described in the present embodiment, an object to which the second terminal housing 7 is attached is not limited to the device per se. It is possible to fix the second terminal housing 7 to another member integrally fixed to the device, e.g., a frame for fixing the device to a chassis or a chassis per se to which the frame or the device is fixed.

Since the second terminal housing 7 at a portion on the cables 61*a* to 61*c* side with respect to the contact points is fixed to the device, it is possible to suppress transmission of vibration of the cables 61*a* to 61*c* to the contact points and thus to suppress frictional wear of the first connecting terminals 4*a* to 4*c* and the second connecting terminals 6*a* to 6*c*.

In the meantime, vibration of the cables 61*a* to 61*c* not only causes frictional wear of the connecting terminals 4*a* to 4*c* and 6*a* to 6*c* but also has an impact on the fitted state of the two terminal housings 5 and 7. A packing is interposed between the two terminal housings 5 and 7 for the purpose of waterproof but the packing may be deformed if the vibration of the cables 61*a* to 61*c* is transmitted to the second terminal housing 7 and this may hinder the waterproof function. In order to prevent the vibration of the cables 61*a* to 61*c* from affecting on the fitted state of the two terminal housings 5 and 7, a portion of the second terminal housing 7 to be fitted to the device should be as close to the cables 61*a* to 61*c* as possible. Therefore, in the present embodiment, the fixing means 40 is provided on the cable insertion portion 36*a* so that the cable insertion portion 36*a* is fixed to the device.

In detail, in the present embodiment, the fixing means 40 is composed of a bolt fixing portion 41 to be fixed to the device by a bolt (not shown) and a connecting portion 42 for connecting the bolt fixing portion 41 to the cable insertion portion 36*a*. A bolt insertion hole 41*a* for inserting a bolt is formed on the bolt fixing portion 41.

In the connector 1, the bolt fixing portion 41 is provided at a position protruding in the arrangement direction of the cables 61*a* to 61*c* beyond the lid portion 24 in order to avoid contact with the flange-shaped lid portion 24 of the first terminal housing 5, and the connecting portion 42 is formed in an L-shape composed of a horizontal portion 42*a* extending from the bolt fixing portion 41 in the arrangement direction of the cables 61*a* to 61*c* and a vertical portion 42*b* vertically extending from an end portion of the horizontal portion 42*a* opposite to the bolt fixing portion 41 and integrally fixed, at a tip thereof, to the cable insertion portion 36*a*. The bolt fixing portion 41 protrudes downward (toward the device) with respect to the horizontal portion 42*a* of the connecting portion 42 so that the lower surface (the surface on the device side) is flush with the lower surface of the lid portion 24 (the surface on the device side). Two fixing means 40 are provided so as to be symmetric with respect to the center of the cable insertion portion 36*a* in the arrangement direction of the cables 61*a* to 61*c* (the lamination direction of the laminated structure).

Note that, the specific structure of the fixing means 40 is not limited thereto. For example, a band-like member covering the entire cable insertion portion 36*a* may be fixed to the device. Alternatively, it may be configured such that the bolt fixing portions 41 are formed on the lid portion 24 and holes in communication with the bolt insertion holes 41*a* are formed on the lid portion 24, and the lid portion 24 and the bolt fixing portions 41 (i.e., the first terminal housing 5 and the second terminal housing 7) are fixed all together by bolts. In addition, when the first terminal housing 5 is a portion of the shielding case, the bolt fixing portion 41 may be formed so that the lower surface thereof is flush with the upper surface of the first terminal housing 5.

Furthermore, even if the second terminal housing 7 is fixed, vibration of the cables 61*a* to 61*c* in the second terminal housing 7 still may be transmitted and may cause frictional wear of the connecting terminals 4*a* to 4*c* and 6*a* to 6*c*. Thus, in the present embodiment, the cables 61*a* to 61*c* are fixed to the second terminal housing 7 to prevent oscillation of the cables 61*a* to 61*c* from being transmitted and causing frictional wear of the first connecting terminals 4*a* to 4*c* and the second connecting terminals 6*a* to 6*c*.

In detail, as shown in FIGS. 8A and 8B, the cables 61*a* to 61*c* are sandwiched by a tail plate(s) 50 having a two-divided structure provided with holding holes 50*a* for sandwiching and holding the cables 61*a* to 61*c*, claws 50*b* provided on the tail plate 50 are locked to grooves 36*d* (see FIGS. 11A and 11B) of the cable insertion portion 36*a* to fix the tail plate 50 to the cable insertion portion 36*a*, and the cables 61*a* to 61*c* are thereby fixed to the cable insertion portion 36*a* via the tail plate 50. Two tail plates 50 are used to fix the cables 61*a* to 61*c* more firmly in the present embodiment but the number of the tail plates 50 may be one. The tail plate 50 is restricted from moving to the inside of the cylindrical body 36 by the wall in the periphery of the insertion holes 36*f* (see FIG. 11A) and thereby serves to reduce the cables 61*a* to 61*c* from being forcibly pushed in the cylindrical body 36. Furthermore, the tail plate 50 serves to hold a non-illustrated waterproof packing in the second terminal housing 7. The waterproof packing reduces entrance of water into the second terminal housing 7 along the cables 61*a* to 61*c* and is provided between the two tail plates 50.

A braided shield may be wound around the cables 61*a* to 61*c* led out of the second terminal housing 7 in order to improve the shielding performance even though it is not illustrated. For example, the braided shield is electrically connected to the first terminal housing 5 via the second terminal housing 7 and is kept at ground potential.

Furthermore, the outer periphery of the cable insertion portion 36*a* from where the cables 61*a* to 61*c* are led out is covered by a rubber boot for preventing water from entering into the cable insertion portion 36*a* or the cylindrical body 36, even though it is not illustrated.

Figure 11A:
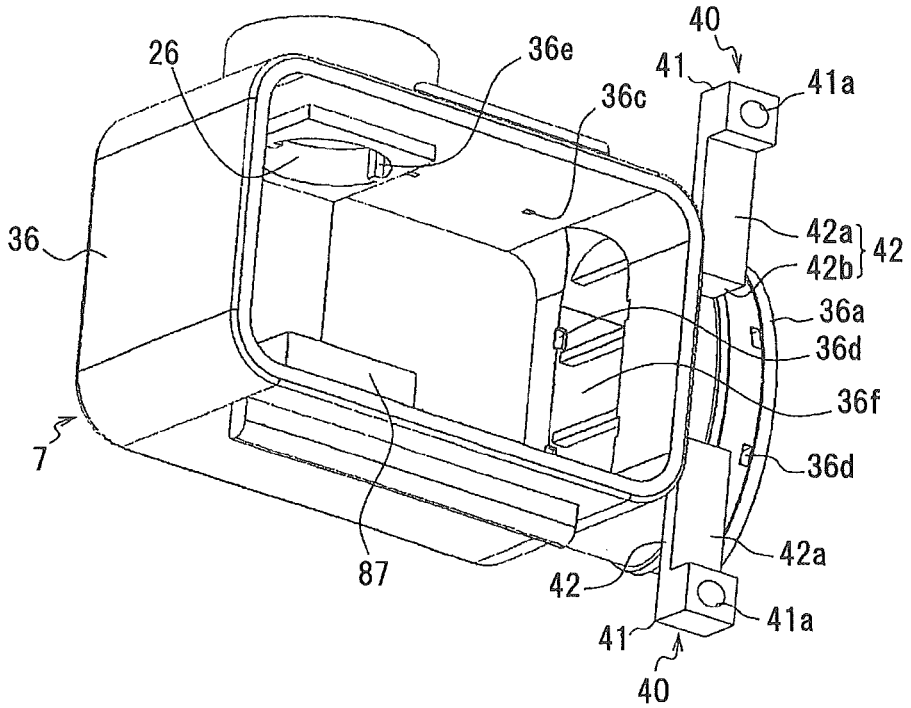
FIGS. 11A and 11B are perspective views showing the second terminal housing of the second connector portion of FIG. 7.
Figure 11B:
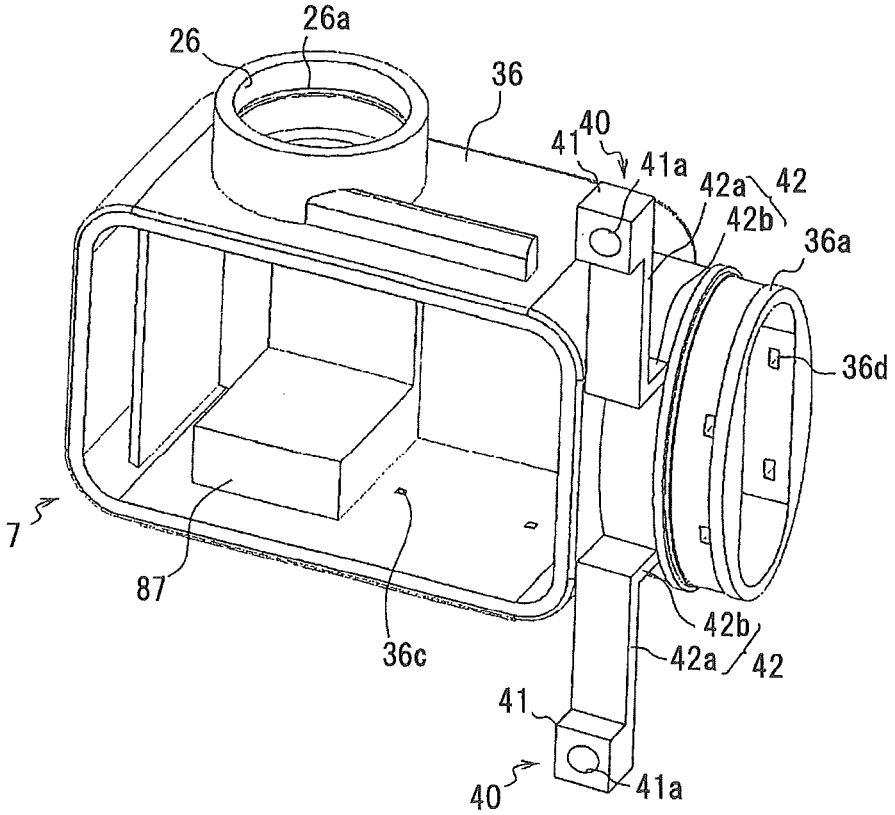

Meanwhile, a connecting member insertion hole 26 for inserting the connecting member 9 is formed on an upper portion of the cylindrical body 36 (on the upper side in FIGS. 11A and 11B). The second terminal housing 7 is formed to have a cylindrical shape (hollow cylinder) at the rim of the connecting member insertion hole 26.

A rectangular parallelepiped-shaped pedestal 87 protruding toward the connecting member insertion hole 26 is provided on an inner peripheral surface of the cylindrical body 36 at a position facing the connecting member insertion hole 26. In the connector 1, the laminated structure is sandwiched and held between the connecting member 9 and the pedestal 87, and a pressing force is applied to the laminated structure by pressing the connecting member 9 toward the pedestal 87 and is thereby applied to each contact point. In addition, locking grooves 36*c* are provided on the inner peripheral surface of the cylindrical body 36. The locking grooves 36*c* are locked to the locking protrusions 30*f* of the second inner housing 30, thereby fixing the second inner housing 30 to the cylindrical body 36.

Figure 12:
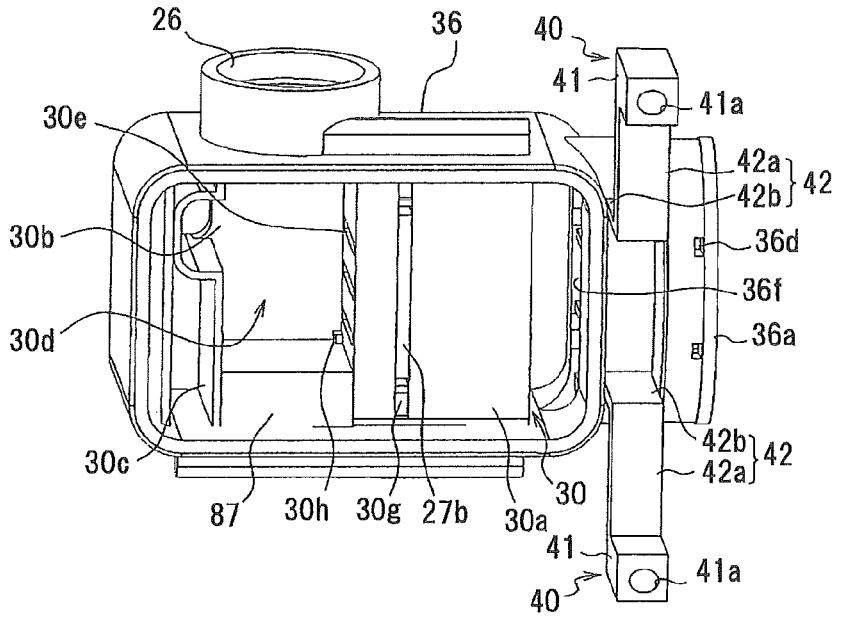
FIG. 12 is a perspective view showing the state in which the second inner housing of FIGS. 10A and 10B is attached to the second terminal housing of FIGS. 11A and 11B.
Figure 13A:
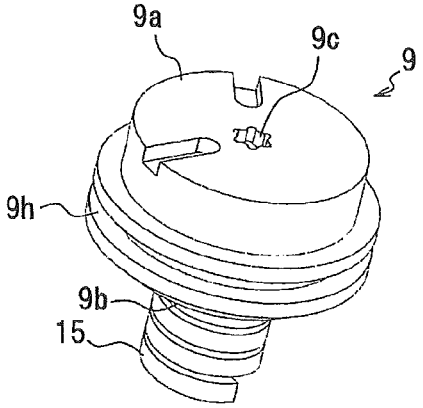
Figure 13B:
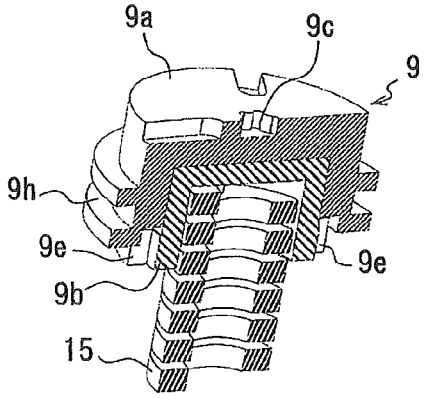
Figure 13C:
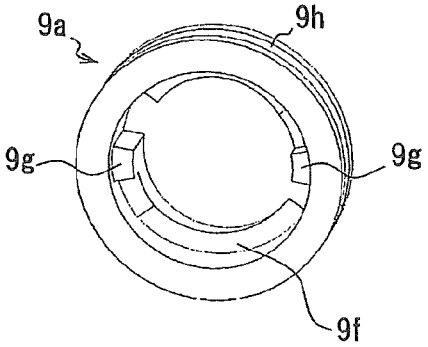
Figure 13D:
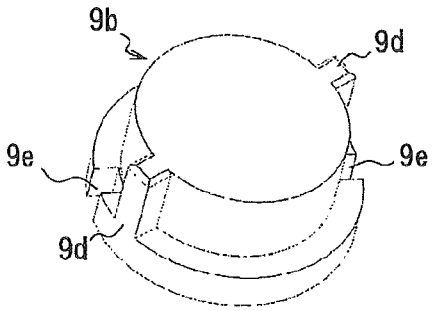
Figure 14A:
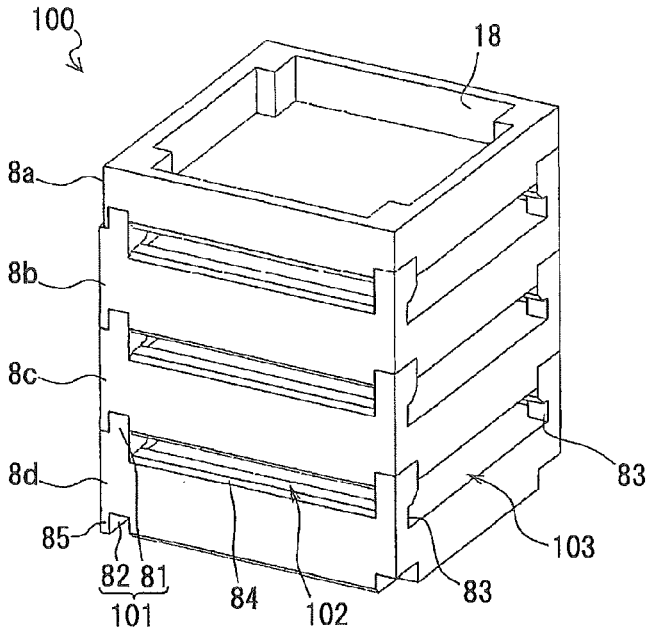
FIG. 14A is a perspective view showing the insulating member assembly of the second connector portion of FIG. 7.
Figure 14B:
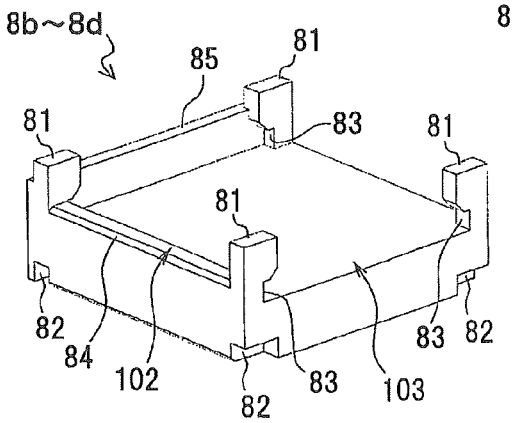
FIGS. 14B and 14C are perspective views showing a first insulating member.
Figure 14C:
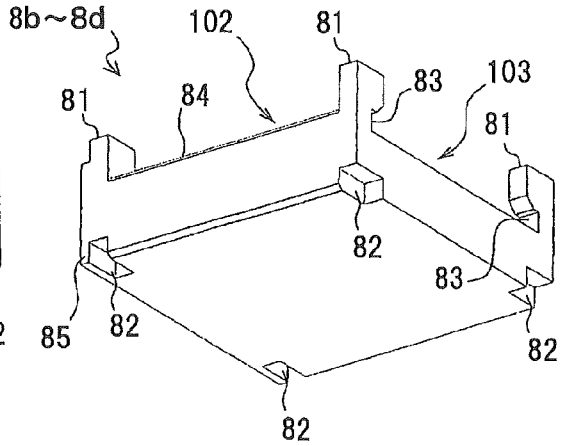

As shown in FIG. 12, the second inner housing 30 is arranged so that the main body 30*a* is arranged next to the pedestal 87 on the cable insertion portion 36*a* side, the parallel portion 30*b* extends over the pedestal 87 and the vertical portion 30*c* is located on a side of the pedestal 87 opposite to the cable insertion portion 36*a*. Once the second inner housing 30 is attached to the second terminal housing 7, the positioning protrusions 30*h* of the second inner housing 30 are placed on the pedestal 87.

For shielding performance, heat dissipation and weight saving of the connector 1, the second terminal housing 7 is preferably formed of light metal having high electrical and thermal conductivity such as aluminum, but may be formed of resin, etc. In the present embodiment, the cylindrical body 36 is formed of aluminum.

As shown in FIGS. 2A, 2B and 7 to 8B, among the plural insulating members 8*a* to 8*d*, the plural first insulating members 8*b* to 8*d* are aligned and housed in the second terminal housing 7 and are also provided integrally with the respective surfaces of the plural second connecting terminals 6*a* to 6*c* on another side (surfaces opposite to the surfaces connected to the first connecting terminals 4*a* to 4*c*), and a second insulating member 8*a* is provided so as to face the surface of the outermost first connecting terminal 4*a* (the uppermost side in FIGS. 2A, 2B and 7 to 8B) on another side (a surface opposite to the surface connected to the second connecting terminal 6*a*) when the plural first connecting terminals 4*a* to 4*c* and the plural second connecting terminals 6*a* to 6*c* form a laminated state.

In the connector 1 of the present embodiment, the insulating member assembly 100, which has an insulating member restricting means 101 for restricting movement of the insulating members 8*a* to 8*d* in a direction perpendicular to a lamination direction of the laminated structure, is formed by connecting the insulating members 8*a* to 8*d* to each other. The insulating member restricting means 101 is configured to restrict movement of the insulating members 8*a* to 8*d* in the x-y plane of the orthogonal coordinate system in which the lamination direction of the laminated structure is the z-axis.

Holes for inserting the connecting terminals 4*a* to 4*c* and 6*a* to 6*c* to be inserted orthogonal to each other, i.e., first terminal insertion holes 102 for inserting the first connecting terminals 4*a* to 4*c* and second terminal insertion holes 103 for inserting the second connecting terminals 6*a* to 6*c*, are provided on the insulating member assembly 100. The first terminal insertion hole 102 is formed between adjacent two of the insulating members 8*a* to 8*d* and the second terminal insertion hole 103 is formed on each of the first insulating members 8*b* to 8*d*. The insulating member assembly 100 will be described in detail later.

As shown in FIGS. 13A to 13D, the connecting member 9 is composed of the cam 9*a* and a bolt 9*b*. The cam 9*a* is formed in a cylindrical shape opening only on the lower side and has an irregular-shaped hole 9*c* (in the present embodiment, a hole having a star shape) formed on an upper surface so that a tool such as wrench can be fitted to rotate the cam 9*a*. On the side surface of the cam 9*a*, a groove 9*h* is formed to house a packing 14 (see FIG. 2A) such as O-ring which is provided to keep water from entering the second terminal housing 7. The lower portion of the cam 9*a* (including a position for forming the groove 9*h*) has an enlarged diameter having a flange shape. When inserting the cam 9*a* into the connecting member insertion hole 26 of the second terminal housing 7 and fitting and fixing a ring-shaped fixing member 26*b* into a groove 26*a* formed on the inner peripheral surface of the connecting member insertion hole 26 as shown in FIG. 2A, the flange portion which comes into contact with the fixing member 26*b* restricts movement of the cam 9*a* toward the outside and the cam 9*a* is thus rotatably held between the second terminal housing 7 and the fixing member 26*b*, An upper portion of the bolt 9*b* is inserted into the hollow portion in the cam 9*a*. The bolt 9*b* is formed in a cylindrical shape opening only on the lower side and has raised portions 9*d* which are formed at circumferentially opposite positions so as to protrude outward (see FIG. 13D). The bolt 9*b* has a flange-like enlarged diameter at the lower portion thereof. Notches 9*e* formed on the flange portion are slidably engaged with linear protrusions 36*e* (see FIG. 11A) formed on the second terminal housing 7 so as to extend vertically, which allows the bolt 9*b* to slide in a vertical direction without rotating together with the cam 9*a*.

Slopes 9*f* gradually protruding downward along the circumferential direction are formed at a rim of the upper surface of the cam 9*a* inside the hollow portion. Two slopes 9*f* are formed at 180° rotationally symmetric positions around a rotational axis of the cam 9*a* so as to correspond to the two raised portions 9*d* of the bolt 9*b*. A stopper 9*g* which comes into contact with the raised portion 9*d* of the bolt 9*b* to prevent excessive rotation is provided at an end portion of each slope 9*f* on the downwardly protruding side.

The connecting member 9 is configured that, when the cam 9*a* is rotated, the slopes 9*f* come into contact with the raised portions 9*d* of the bolt 9*b* and moves the bolt 9*b* toward the second insulating member 8*a* and the second insulating member 8*a* is thereby pressed. Due to such a configuration, the cam 9*a* to be rotated by a worker is always located at a certain position and does not move vertically, which improves workability.

The cam 9*a* and the bolt 9*b* which are formed of a metal such as SUS, iron or copper alloy are used. The cam 9*a* and the bolt 9*b* may be formed of a resin but are preferably formed of metal from the viewpoint of strength.

Meanwhile, an elastic member 15 for applying a predetermined pressing force to the second insulating member 8*a* is provided between the bolt 9*b* of the connecting member 9 and the upper surface of the second insulating member 8*a* immediately therebelow. In the present embodiment, the upper portion of the elastic member 15 is housed in the hollow portion in the bolt 9*b*. This is an idea to reduce a distance between the bolt 9*b* and the second insulating member 8*a* and to downsize the connector 1 even when the elastic member 15 is long to some extent. The elastic member 15 is constructed from, e.g., a spring formed of metal (e.g., SUS, etc.). Note that, the elastic member 15 is regarded as a portion of the connecting member 9 in the present embodiment.

A concave portion 16 covering (housing) a lower portion of the elastic member 15 is formed on the upper surface of the second insulating member 8*a* with which the lower portion of the elastic member 15 is in contact, and a receiving member 17 formed of metal (e.g., SUS, etc.) for preventing the second insulating member 8*a* formed of an insulating resin from being damaged by receiving the elastic member 15 is provided on a bottom of the concave portion 16 (i.e., a seat portion with which the lower portion of the elastic member 15 is in contact).

The receiving member 17 is to prevent damage on the second insulating member 8*a* by dispersing stress applied from the elastic member 15 to the upper surface of the second insulating member 8*a*. Therefore, a contact area between the receiving member 17 and the second insulating member 8*a* is preferably as large as possible. The receiving member 17 having a shape in contact throughout the entire bottom surface of the concave portion 16 is provided in the present embodiment in order to increase the contact area between the receiving member 17 and the second insulating member 8*a*.

Connection Between First Connector Portion and Second Connector Portion

When the two terminal housings 5 and 7 are fitted to each other, the first connecting terminals 4*a* to 4*c* are respectively inserted into the first terminal insertion holes 102 and are then inserted into respective gaps between the second connecting terminals 6*a* to 6*c* to be respectively paired therewith and the insulating members 8*a* to 8*d*. This insertion provides a laminated structure in which the surfaces of the plural first connecting terminals 4*a* to 4*c* on the one side face the surfaces of the plural second connecting terminals 6*a* to 6*c* on the one side to form the respective pairs, and the first connecting terminals 4*a* to 4*c*, the second connecting terminals 6*a* to 6*c* and the insulating members 8*a* to 8*d* are alternately arranged, i.e., the insulating members 8*a* to 8*d* are arranged so as to sandwich the pairs of the first connecting terminals 4*a* to 4*c* and the second connecting terminals 6*a* to 6*c*.

At this time, in the second connector portion 3, since the first insulating members 8*b* to 8*d* are respectively provided at the tips of the second connecting terminals 6*a* to 6*c* aligned and held at predetermined intervals, each gap between the insulating members 8*b* to 8*d* can be kept without additionally providing a retaining jig for keeping respective gaps between the insulating members 8*b* to 8*d*. This makes easy to insert the first connecting terminals 4*a* to 4*c* into the respective gaps between the second connecting terminals 6*a* to 6*c* to be respectively paired therewith and the insulating members 8*a* to 8*d*. In other words, the insertion and extraction properties of the first connecting terminals 4*a* to 4*c* are not degraded. In addition, it is very effective in that it is possible to realize further downsizing as compared to the conventional art since it is not necessary to provide a retaining jig for keeping the gaps between the insulating members 8*b* to 8*d*.

Meanwhile, a contact point between the first connecting terminal 4*a* and the second connecting terminal 6*a* is sandwiched between the second insulating member 8*a* and the first insulating member 8*b* attached to the second connecting terminal 6*a* constituting the contact point. Likewise, a contact point between the first connecting terminal 4*b* (or 4*c*) and the second connecting terminal 6*b* (or 6*c*) is sandwiched between the first insulating member 8*c* (or 8*d*) attached to the second connecting terminal 6*b* (or 6*c*) constituting the contact point and the first insulating member 8*b* (or 8*c*) attached to the second connecting terminal 6*a* (or 6*b*) constituting another contact point.

When the cam 9*a* of the connecting member 9 is turned by a tool such as wrench in this state so as to be pressed downward, the second insulating member 8*a*, the first insulating member 8*b*, the first insulating member 8*c* and the first insulating member 8*d* are pressed in this order by the elastic member 15, a pressing force is applied to each contact point by any two of the insulating members 8*a* to 8*d* sandwiching and pressing each contact point, causing contact in a state that contact points are insulated from each other. At this time, the first connecting terminals 4*a* to 4*c* and the second connecting terminals 6*a* to 6*c* are bent in some degree due to pressure from the insulating members 8*a* to 8*d* and respectively make contact in a large area. This makes strong contact and fixation of each contact point even under the environment in which vibration occurs, such as in a vehicle.

Insulating Member Assembly

Next, the insulating member assembly 100 will be described in detail.

As shown in FIGS. 2A, 2B, 8A, 8B and 14A to 14C, the insulating member assembly 100 is formed by sequentially connecting the insulating members 8*a* to 8*d* in the lamination direction. That is, the insulating member assembly 100 is formed by respectively connecting the second insulating member 8*a* to the first insulating member 8*b*, the first insulating member 8*b* to the first insulating member 8*c*, and the first insulating member 8*c* to the first insulating member 8*d*.

In the insulating member assembly 100, the insulating member restricting means 101 restricts the insulating members 8*a* to 8*d* from moving in a direction perpendicular to the lamination direction when the insulating members 8*a* to 8*d* are connected to each other. In the insulating member assembly 100, the insulating members 8*a* to 8*d* are connected to be relatively movable in the lamination direction in order to transfer a pressing force of the connecting member 9 to each contact point.

The insulating member restricting means 101 is provided with plural connecting pieces 81 and plural connecting grooves 82. The connecting pieces 81 are provided on one of the two insulating members 8*a*, 8*b*, 8*c* or 8*d* adjacent in the lamination direction and protrude toward the other adjacent insulating member 8*a*, 8*b*, 8*c* or 8*d*. The connecting grooves 82 are provided on the other adjacent insulating member 8*a*, 8*b*, 8*c* or 8*d* so as to correspond to the plural connecting pieces 81 and receive the connecting pieces 81 so as to be slidable in the lamination direction.

In the present embodiment, the insulating members 8*a* to 8*d* are formed in a substantially rectangular shape as viewed from the lamination direction thereof and one or both of the connecting piece 81 and the connecting groove 82 are formed at least at two of four corners of the insulating members 8*a* to 8*d*. Here, the case where one or both of the connecting piece 81 and the connecting groove 82 are formed at four corners of the insulating members 8*a* to 8*d* will be described.

In insulating member assembly 100, the connecting pieces 81 are integrally formed on the first insulating members 8*b* to 8*d* so as to extend from four corners in the width direction of the first insulating members 8*b* to 8*d* toward the opposite insulating members 8*a* to Sc (toward the second insulating member 8*a* from the first insulating member 8*b*, toward the first insulating member 8*b* from the first insulating member 8*c* and toward the first insulating member 8*c* from the first insulating member 8*d*) with interposition of the second connecting terminals 6*a* to 6*c* to which the first insulating members 8*b* to 8*d* are attached.

In addition, the connecting grooves 82 for receiving the connecting pieces 81 so as to be slidable in the lamination direction are respectively formed on the both side surfaces of the insulating members 8*a* to 8*c* opposite to the first insulating members 8*b* to 8*d* (facing with interposition of the second connecting terminals 6*a* to 6*c* to which the first insulating members 8*b* to 8*d* are attached). In the present embodiment, the plural first insulating members 8*b* to 8*d* are formed to have the same shape and the connecting grooves 82 are also formed on the first insulating members 8*d* which is located at the outermost position. In addition, in the present embodiment, the connecting piece 81 and the connecting groove 82 are formed in a substantially rectangular shape as viewed from the lamination direction.

Forming the plural first insulating members 8*b* to 8*d* into the same shape allows the number of components and the cost to be reduced and also allows the insulating member assembly 100 to be positioned with respect to the second terminal housing 7 by using the connecting grooves 82 formed on the outermost first insulating member 8*d*. In the present embodiment, the insulating member assembly 100 is positioned with respect to the second terminal housing 7 by inserting the positioning protrusions 30*h* provided inside the second terminal housing 7 (see FIGS. 10A, 10B and 12) into the connecting grooves 82 of the first insulating member 8*d*. Note that, although the positioning protrusions 30*h* are formed on the second inner housing 30 in the present embodiment, it is obviously possible to form the positioning protrusions 30*h* directly on the second terminal housing 7.

The insulating members 8*a* to 8*d* are connected to be relatively movable in the lamination direction by respectively receiving the connecting pieces 81 of the first insulating member 8*b* in the connecting grooves 82 of the second insulating member 8*a*, the connecting pieces 81 of the first insulating member 8*c* in the connecting grooves 82 of the first insulating member 8*b* and the connecting pieces 81 of the first insulating member 8*d* in the connecting grooves 82 of the first insulating member 8*c*, and the insulating member assembly 100 is thereby formed.

In addition, the insulating member assembly 100 is configured that, when the insulating members 8*a* to 8*d* are connected (laminated), the front edge (top edge) of the connecting piece 81 is stopped by the upper surface of the connecting groove 82 and each gap between the insulating members 8*a* to 8*d* is controlled so as not to be narrower than a predetermined gap (the minimum lamination gap).

The minimum lamination gap is adjusted to be slightly smaller than the total thickness (contact point thickness) of the first connecting terminal 4*a*, 4*b* or 4*c* and the second connecting terminal 6*a*, 6*b* or 6*c* which constitute a contact point. It is because a pressing force from the connecting member 9 is not transferred to the contact point if the minimum lamination gap is greater than the contact point thickness and if, on the other hand, the minimum lamination gap is too small, the positional misalignment of the insulating members 8*a* to 8*d* in the lamination direction become too large when the second connecting terminals 6*a* to 6*c* are deformed for some reasons and this causes defects such as deterioration in fitting properties. The minimum lamination gap can be adjusted by adjusting a difference in length in the lamination direction between the connecting piece 81 and the connecting groove 82 (for example, the minimum lamination gap is increased with increasing the length of the connecting piece 81 with respect to the length of the connecting groove 82).

Figure 15A:
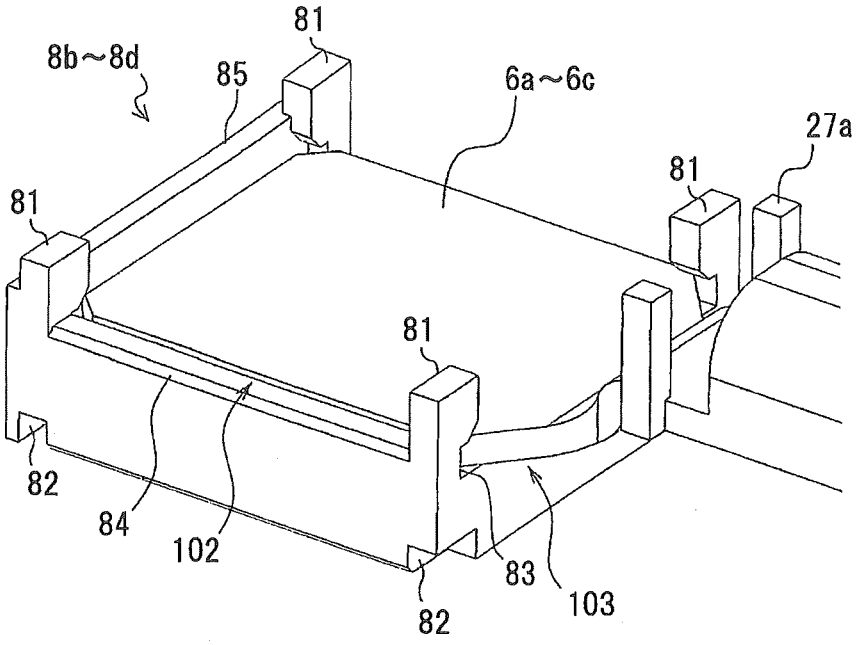
FIG. 15A is a perspective view showing the first insulating member and a second connecting terminal.

As shown in FIG. 15A, the four connecting pieces 81 of the first insulating members 8*b* to 8*d* are formed in a substantially Γ-shape or a substantially mirror-reversed Γ-shape as viewed from the length direction of the second connecting terminals 6*a* to 6*c*, and a squared U-shaped fitting groove 83 opening inward is formed on each connecting piece 81. The first insulating members 8*b* to 8*d* are locked and fixed to the second connecting terminals 6*a* to 6*c* by inserting the second connecting terminals 6*a* to 6*c* into the fitting grooves 83. In other words, the connecting piece 81 has a function of connecting the insulating members 8*a* to 8*d* to each other as well as a function of locking the second connecting terminals 6*a* to 6*c*, and the fitting grooves 83 of the connecting pieces 81 serve as the second terminal insertion hole 103.

Figure 15B:
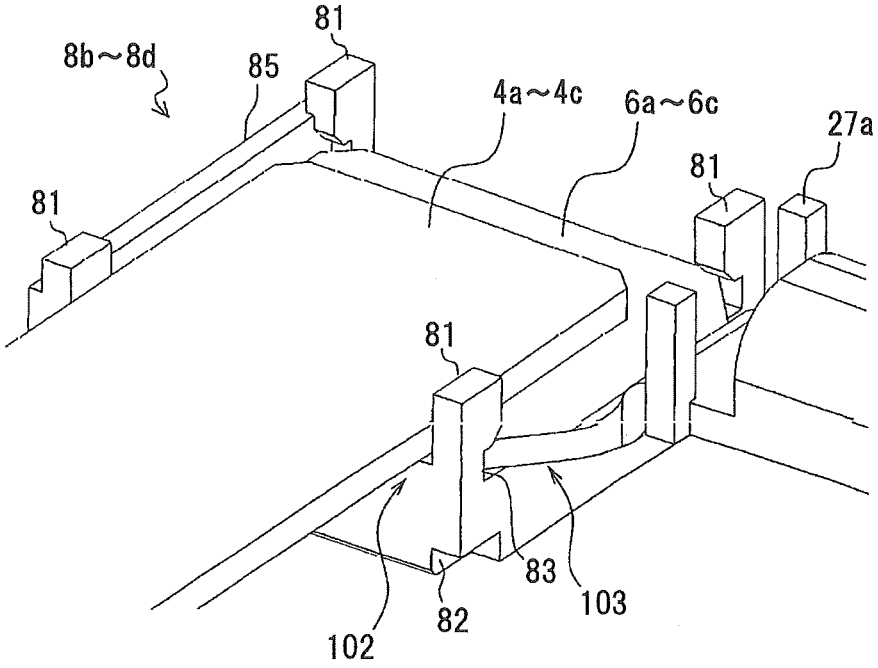
FIG. 15B is a perspective view showing the first insulating member, the second connecting terminal and the first connecting terminal.

On the other hand, as shown in FIGS. 2B and 15B, the first connecting terminals 4*a* to 4*c* are inserted between the connecting pieces 81 which are formed at positions facing the opening of the second terminal housing 7 (on a side from which the first connecting terminals 4*a* to 4*c* are inserted) when the two terminal housings 5 and 7 are fitted to each other. In other words, the connecting pieces 81 formed at the positions facing the opening of the second terminal housing 7 also have a function of guiding and positioning the tip portions of the first connecting terminals 4*a* to 4*c*, and an opening sandwiched by the two connecting pieces 81 between the second connecting terminal 6*a*, 6*b* or 6*c* and the insulating member 8*a*, 8*b* or 8*c* serves as the first terminal insertion hole 102.

In the present embodiment, as shown in FIGS. 15A and 15B, a collision-prevention wall 84 is integrally formed on each of the plural first insulating members 8*b* to 8*d*. The collision-prevention wall 84 covers an end face of the second connecting terminal 6*a*, 6*b* or 6*c* on the side from which the first connecting terminals 4*a* to 4*c* are inserted, in order to prevent collision between the two connecting terminals 4*a*, 4*b* or 4*c* and 6*a*, 6*b* or 6*c* at the time of inserting the first connecting terminal 4*a*, 4*b* or 4*c* between the second connecting terminal 6*a*, 6*b* or 6*c* and the insulating member 8*a*, 8*b* or 8*c*. An edge of each collision-prevention wall 84 is chamfered (or rounded) to facilitate insertion of the first connecting terminals 4*a* to 4*c*. A portion of each of the insulating members 8*a* to 8*c* at a position facing the collision-prevention wall 84 (i.e., an edge of the each of the insulating members 8*a* to 8*c* on the opposite side to the connecting member 9 and on the side from which the first connecting terminals 4*a* to 4*c* are inserted) is also chamfered (or rounded) in the same manner. An edge of the connecting piece 81 on the first terminal insertion hole 102 side may be also chamfered or rounded to further facilitate insertion of the first connecting terminals 4*a* to 4*c* even though it is not performed in the present embodiment. The collision-prevention wall 84 is formed so that the upper surface thereof is flush with the upper surface of the second connecting terminal 6*a*, 6*b* or 6*c*.

Since the first insulating members 8*b* to 8*d* is attached to the second connecting terminals 6*a* to 6*c*, the first insulating members 8*b* to 8*d* are held by the second terminal housing 7 via the second connecting terminals 6*a* to 6*c* and the second inner housing 30 and are positioned with respect to the first terminal housing 5. In the state that the first insulating members 8*b* to 8*d* are positioned with respect to the first terminal housing 5, a gap is formed between the front edge of the connecting piece 81 and the upper surface of the connecting groove 82 and the first insulating members 8*b* to 8*d* are relatively movable to each other in the lamination direction. At this time, the insulating members 8*a* to 8*d* are housed in the space 30*d* surrounded by the main body 30*a*, the parallel portion 30*b* and the vertical portion 30*c* of the second inner housing 30 (see FIGS. 10A, 10B and 12).

The fitting groove 83 is formed so that a width thereof in the lamination direction (a width of the squared U-shaped opening) is slightly larger than the thickness of the second connecting terminals 6*a* to 6*c*. Thus, a gap (or clearance) is formed between the fitting groove 83 and the second connecting terminal 6*a*, 6*b* or 6*c* when the second connecting terminal 6*a*, 6*b* or 6*c* is fitted to the fitting groove 83. Accordingly, the first insulating members 8*b* to 8*d* are provided having looseness with respect to the second connecting terminals 6*a* to 6*c*. Since the first insulating members 8*b* to 8*d* are provided having looseness with respect to the second connecting terminals 6*a* to 6*c*, the first insulating members 8*b* to 8*d* can flexibly move even when the first insulating members 8*b* to 8*d* are slightly out of alignment. Therefore, deterioration in fitting properties such as hitting of the first connecting terminals 4*a* to 4*c* against the first insulating members 8*b* to 8*d* can be suppressed. In addition, forming the gaps (or clearances) between the fitting grooves 83 and the second connecting terminals 6*a* to 6*c* allows the second connecting terminals 6*a* to 6*c* to be easily fitted to the fitting grooves 83. Note that, a rim of the fitting groove 83 (and an edge of the first insulating members 8*b* to 8*d* on the side from which the second connecting terminals 6*a* to 6*c* are inserted) may be chamfered or rounded in order to easily fit the second connecting terminal 6*a*, 6*b* or 6*c* into the fitting grooves 83 even though it is not performed in the present embodiment.

In addition, a connecting wall 85 is integrally formed on each of the first insulating members 8*b* to 8*d* so as to connect between the two connecting pieces 81 located opposite to the side from which the second connecting terminals 6*a* to 6*c* are inserted. The connecting wall 85 is provided parallel to the insertion direction of the first connecting terminals 4*a* to 4*c* so as to cover a side of the fitting groove 83 opposite to the side from which the second connecting terminals 6*a* to 6*c* are inserted, which improves mechanical strength of the connecting pieces 81. In addition, the tip portions of the second connecting terminals 6*a* to 6*c* hit against the connecting walls 85. Therefore, the connecting wall 85 serves to position the second connecting terminals 6*a* to 6*c* and to suppress excessive insertion thereof. Furthermore, the connecting wall 85 extends downward so as to cover a side of the connecting groove 82 opposite to the side from which the second connecting terminals 6*a* to 6*c* are inserted. This increases a contact area when the connecting piece 81 is inserted into the connecting groove 82. Thus, the connecting wall 85 also has a function of further stabilizing the connection between the insulating members 8*b* to 8*d* to each other. Note that, the connecting wall 85 is formed at a height that does not hit the opposite insulating member 8*a*, 8*b* or 8*c* when each gap between the insulating members 8*a* to 8*d* is set to the minimum lamination gap.

Furthermore, as shown in FIG. 15B, the connecting wall 85 covers the lateral side of the first connecting terminal 4*a*, 4*b* or 4*c* and serves to increase a creepage distance between the contact points when the two terminal housings 5 and 7 are fitted and the first connecting terminals 4*a* to 4*c* are inserted. Such a configuration is effective especially when reducing the size of the insulating members 8*b* to 8*d* to downsize the entire connector 1. Note that, in the present embodiment, a connecting wall is not formed on a side of the insulating members 8*b* to 8*d* opposite to the side from which the first connecting terminals 4*a* to 4*c* are inserted since it is configured that the first connecting terminals 4*a* to 4*c* are inserted partway without covering the entire second connecting terminals 6*a* to 6*c* when the two terminal housings 5 and 7 are fitted and this increases the creepage distance between the contact points via the side of the insulating members 8*b* to 8*d* opposite to the side from which the first connecting terminals 4*a* to 4*c* are inserted, however, it is obviously possible to further form a connecting wall on the side of the insulating members 8*b* to 8*d* opposite to the side from which the first connecting terminals 4*a* to 4*c* are inserted.

Although the connecting pieces 81 are formed on the first insulating members 8*b* to 8*d* and the connecting grooves 82 are formed on the opposite insulating members 8*a* to 8*c* in the present embodiment, it is obviously possible to reverse the positions of the connecting pieces 81 and the connecting grooves 82 in the insulating member assembly 100 (to form the connecting pieces 81 on the insulating members 8*a* to 8*c* and the connecting grooves 82 on the opposite insulating members 8*b* to 8*d*). In this case, however, it is not possible to form the fitting groove 83 on the connecting piece 81 and a mechanism for providing the first connecting terminals 4*a* to 4*c* needs to be additionally provided on the first insulating members 8*b* to 8*d*, which makes the structure of the first insulating members 8*b* to 8*d* complicated.

Effects of the Present Embodiment

The effects of the present embodiment will be described.

The connector 1 in the present embodiment is provided with the fixing means 40 which are a portion of the second terminal housing 7 on the cables 61*a* to 61*c* side with respect to the contact points and fix a portion housing the cables 61*a* to 61*c* to the device or another member integrally fixed to the device.

Since the second terminal housing 7 at a portion on the cables 61*a* to 61*c* side with respect to the contact points is fixed to the device, etc., it is possible to suppress transmission of vibration of the cables 61*a* to 61*c* to the contact points and thus to suppress frictional wear of the connecting terminals 4*a* to 4*c* and 6*a* to 6*c* caused by vibration even in a condition where vibration is likely to occur, such as under the in-vehicle environment.

In addition, since the connector 1 is configured that the fixing means 40 are provided on the cable insertion portion 36*a* from which the cables 61*a* to 61*c* extend so that the cable insertion portion 36*a* is fixed to the device, etc., it is possible to suppress influence of the vibration of the cables 61*a* to 61*c* on the fitted state of the two terminal housings 5 and 7 and thus to suppress hindrance of the waterproof function, etc.

Furthermore, since the connector 1 has the tail plates 50 having a two-divided structure to sandwich and hold the cables 61*a* to 61*c* and the cables 61*a* to 61*c* are fixed to the second terminal housing 7 by fixing the tail plates 50 to the second terminal housing 7, it is possible to suppress transmission of vibration to the connecting terminals 4*a* to 4*c* and 6*a* to 6*c* when the cables 61*a* to 61*c* vibrate in the second terminal housing 7 and it is thus possible to reliably suppress frictional wear of the connecting terminals 4*a* to 4*c* and 6*a* to 6*c*.

In the connector 1, since the contact points are formed in the second terminal housing 7 and outside the device, frictional wear of the connecting terminals 4*a* to 4*c* and 6*a* to 6*c* due to vibration of the second terminal housing 7 is likely to occur. The invention exerts remarkable effects especially in such a case.

Furthermore, the connector 1 has a laminated structure in which plural contact points are held all together by being pressed by the connecting member 9. Therefore, remarkable effects are obtained especially when the invention is applied to such a laminated-type connector.

It should be noted that the present invention is not intended to be limited to the embodiment, and the various changes can be made without departing from the gist of the present invention.

For example, the case where the invention is applied to the laminated-type connector 1 has been described in the embodiment, the invention is also applicable to connectors other than of the laminated-type and it is obviously applicable to, e.g., a connector provided with only a pair of a first connecting terminal and a second connecting terminal.

The embodiment assumes the use of a three-phase AC power line, however, according to the technical idea of the invention, it may be, e.g., a connector for a vehicle which is configured to collectively connect lines used for different purposes such as a three-phase AC power line between a motor and an inverter and a two-phase DC power line for air conditioner. Since the configuration described above allows one connector to collectively connect power lines used for different purposes, it is not necessary to prepare different connectors for each intended purpose and it is thus possible to contribute to space saving and cost reduction.

In addition, surfaces of the first connecting terminals 4*a* to 4*c* and of the second connecting terminals 6*a* to 6*c* may be each roughened by a knurling process to increase frictional force so as to make the terminals difficult to move, thereby strengthening the fixation at each contact point.

In addition, although the case where the first connector portion 2 is attached to the device has been described in the embodiment, it is possible to configure such that the first connecting terminals 4*a* to 4*c* are provided at end portions of cables to connect the cables to each other.

Furthermore, although the first connecting terminals 4*a* to 4*c* are inserted through the through-holes 10*a* of the first inner housing 10 and are fixed to the first inner housing 10 in the embodiment, the first inner housing 10 may be integrally formed with the first connecting terminals 4*a* to 4*c* by insert molding.

In addition, although the case where the first insulating members 8*b* to 8*d* are attached to the second connecting terminals 6*a* to 6*c* by fitting the second connecting terminals 6*a* to 6*c* to the fitting grooves 83 has been described in the embodiment, the first insulating members 8*b* to 8*d* may be fixed to the second connecting terminals 6*a* to 6*c* by insert molding or by press-fitting the second connecting terminals 6*a* to 6*c* into the first insulating members 8*b* to 8*d*. In this regard, however, the first insulating members 8*b* to 8*d* do not have looseness with respect to the second connecting terminals 6*a* to 6*c* in case of using insert molding or press-fitting and it is therefore desirable to fit the second connecting terminals 6*a* to 6*c* to the fitting grooves 83 in view of improving fitting properties.

In addition, although a cable excellent in flexibility is used as the cables 61*a* to 61*c* in the embodiment, a rigid cable may be used.

In addition, in the embodiment, a direction of the connecting member 9 may be either substantially horizontal or substantially vertical when the connector is in use. In other words, a direction in a usage state is not a requirement in the use conditions of the connector of the present embodiment.

In addition, although the bolt 9*b* of the connecting member 9 presses the second insulating member 8*a* adjacent thereto via the elastic member 15 which is a portion of the connecting member 9 in the embodiment, the adjacent second insulating member 8*a* may be pressed directly by the bolt 9*b*, not via the elastic member 15.

In addition, although the case of providing the connecting member 9 on only one side of the first terminal housing 5 has been described in the embodiment, the connecting member 9 may be provided on both sides of the first terminal housing 5 so that a pressing force is applied to each contact point by the two connecting members 9 provided on the both sides.

Although the case where one or both of the connecting piece 81 and the connecting groove 82 are formed at four corners of the insulating members 8*a* to 8*d* has been described in the embodiment, it is not limited thereto. The connecting piece 81 and the connecting groove 82 may be formed at two or three of the four corners of the insulating members 8*a* to 8*d*.

In addition, the connector 1 may be configured not to include the first connector portion 2. In this case, the wire harness of the invention is the cables 61*a* to 61*c* with the second connector portion 3 provided at an end portion thereof.

What is claimed is:

1. A connector, comprising:

a first terminal housing that houses a first connecting terminal(s) and is attached to a device as an attached object thereof; and a second terminal housing that houses at least a portion of a cable(s) comprising a second connecting terminal(s) at an end portion thereof, wherein the first connecting terminal(s) and the second connecting terminal(s) come into contact with each other and form a contact point(s) when the first terminal housing is fitted to the second terminal housing, wherein the two terminal housings are fitted in a direction crossing an extending direction of the cable(s) that extends from the second terminal housing, wherein the second terminal housing further comprises fixing means on a cable side with respect to the contact point(s) so as to fix a portion housing the cable(s) to the device or another member integrally fixed to the device, wherein the second terminal housing is formed in a hollow cylinder shape having an opening on one side and further comprises a cylindrical body with the opening to be fitted to the first terminal housing and a cable insertion portion for inserting the cable, the cable insertion portion being formed integrally with a side surface of the cylindrical body so as to be in communication with a hollow portion of the cylindrical body, wherein the fixing means is provided on the cable insertion portion so that the cable insertion portion is fixed to the device or the another member integrally fixed to the device, wherein the cable insertion portion is separated with a predetermined distance from the device or the another member integrally fixed to the device, and wherein the fixing means extends from the cable insertion portion toward the device or the another member integrally fixed to the device, to contact the device or the another member integrally fixed to the device.

2. The connector according to claim 1, wherein the fixing means comprises a bolt fixing portion to be fixed to the device or the another member integrally fixed to the device by a bolt and a connecting portion for connecting the bolt fixing portion to the cable insertion portion.

3. The connector according to claim 1, further comprising a tail plate including a two-divided structure to sandwich and hold the cable(s), wherein the cable(s) is fixed to the second terminal housing by fixing the tail plate to the second terminal housing.

4. The connector according to claim 1, wherein a plurality of the first connecting terminals aligned are housed in the first terminal housing, wherein a plurality of the second connecting terminals aligned and a plurality of insulating members aligned are housed in the second terminal housing, wherein a laminated structure is formed such that the first connecting terminals and the second connecting terminals are alternately arranged so that surfaces of the plurality of first connecting terminals face surfaces of the plurality of second connecting terminals to form pairs and to form a plurality of contact points sandwiched between the insulating members when the first terminal housing is fitted to the second terminal housing, and wherein a connecting member is provided to collectively fix and electrically connect the plurality of first connecting terminals and the plurality of second connecting terminals at each contact point by pressing the insulating member adjacent thereto.

5. The connector according to claim 1, wherein the contact point(s) is formed inside the second terminal housing and outside the device.

6. A wire harness, comprising:

a cable(s);

a second connecting terminal(s) provided at an end portion of the cable(s); and a second terminal housing that houses at least a portion of the cable(s) comprising the second connecting terminal(s) at the end portion thereof, wherein the first connecting terminal(s) and the second connecting terminal(s) come into contact with each other and form a contact point(s) when the second terminal housing is fitted to a first terminal housing that is a housing to be fitted to the second terminal housing, houses the first connecting terminals and is attached to a device as an attached object, wherein the two terminal housings are fitted in a direction crossing an extending direction of the cable(s) that extends from the second terminal housing, wherein the second terminal housing further comprises fixing means on a cable side with respect to the contact point(s) so as to fix a portion having the cable(s) to the device or another member integrally fixed to the device, wherein the second terminal housing is formed in a hollow cylinder shape having an opening on one side and further comprises a cylindrical body with the opening to be fitted to the first terminal housing and a cable insertion portion for inserting the cable, the cable insertion portion being formed integrally with a side surface of the cylindrical body so as to be in communication with a hollow portion of the cylindrical body, wherein the fixing means is provided on the cable insertion portion so that the cable insertion portion is fixed to the device or the another member integrally fixed to the device, wherein the cable insertion portion is separated with a predetermined distance from the device or the another member integrally fixed to the device, and wherein the fixing means extends from the cable insertion portion toward the device or the another member integrally fixed to the device, to contact the device or the another member integrally fixed to the device.

7. The connector according to claim 1, wherein the fixing means comprises a bolt fixing portion to be fixed to the device or the another member integrally fixed to the device and a connecting portion for connecting the bolt fixing portion to the cable insertion portion.

8. The connector according to claim 7, wherein the fixing means further comprises a bolt insertion hole located on the bolt fixing portion for inserting a bolt to the device or the another member integrally fixed to the device.

9. The connector according to claim 7, wherein the bolt fixing portion protrudes, in a direction perpendicular to the extending direction of the cable(s), from an end portion of the connecting portion.

10. The connector according to claim 7, wherein the bolt fixing portion protrudes from the connecting portion in a position located beyond a lid portion of the first terminal housing to avoid contact of the bolt fixing portion with the lid portion of the first terminal housing.

11. The connector according to claim 7, wherein the connecting portion comprises:

a horizontal portion longitudinally extending, from the bolt fixing portion, in a direction perpendicular to the extending direction of the cable(s).

12. The connector according to claim 11, wherein the bolt fixing portion is located at an end portion of the horizontal portion of the connecting portion.

13. The connector according to claim 12, wherein the connecting portion further comprises:

a vertical portion extending, in a direction perpendicular to the extending direction of the cable(s) and perpendicular to a longitudinal extension of the horizontal portion, from another end portion of the horizontal portion toward the cable insertion portion.

14. The connector according to claim 1, wherein the fixing means protrudes from a surface of the cable insertion portion.

15. The wire harness according to claim 6, wherein the fixing means comprises a bolt fixing portion to be fixed to the device or the another member integrally fixed to the device and a connecting portion for connecting the bolt fixing portion to the cable insertion portion.

16. The wire harness according to claim 15, wherein the fixing means further comprises a bolt insertion hole located on the bolt fixing portion for inserting a bolt to the device or the another member integrally fixed to the device.

17. The wire harness according to claim 15, wherein the connecting portion comprises:

a horizontal portion longitudinally extending, from the bolt fixing portion, in a direction perpendicular to the extending direction of the cable(s).

18. The wire harness according to claim 17, wherein the bolt fixing portion is located at an end portion of the horizontal portion of the connecting portion.

19. The wire harness according to claim 18, wherein the connecting portion further comprises:

a vertical portion extending, in a direction perpendicular to the extending direction of the cable(s) and perpendicular to a longitudinal extension of the horizontal portion, from another end portion of the horizontal portion toward the cable insertion portion.

* * * * *